United States Patent [19]

Iijima et al.

[11] 4,153,460

[45] May 8, 1979

[54] LIGHT-SENSITIVE SILVER HALIDE COLOR PHOTOGRAPHIC MATERIAL

[75] Inventors: Toshifumi Iijima, Kokubunji; Tadahiko Obikawa; Motoaki Tanaka, both of Hachioji, all of Japan

[73] Assignee: Konishiroku Photo Industry Co., Ltd, Tokyo, Japan

[21] Appl. No.: 875,885

[22] Filed: Feb. 7, 1978

[30] Foreign Application Priority Data

Feb. 10, 1977 [JP] Japan ..... 52-13599

[51] Int. Cl.[2] ..... G03C 1/76; G03C 1/06

[52] U.S. Cl. ..... 96/74; 96/76 R; 96/77; 96/95; 96/100 R

[58] Field of Search ..... 96/74, 76 R, 95, 100, 96/66, 3, 77

[56] References Cited

U.S. PATENT DOCUMENTS

| | | | |
|---|---|---|---|
| 3,364,022 | 1/1968 | Barr | 96/56.5 |
| 3,892,572 | 7/1975 | Shiba et al. | 96/74 |
| 3,984,245 | 10/1976 | Hirose et al. | 96/74 |
| 4,010,035 | 3/1977 | Fujiwhara et al. | 96/95 |

*Primary Examiner*—Travis Brown

*Attorney, Agent, or Firm*—Bierman & Bierman

[57] ABSTRACT

A light-sensitive silver halide color photographic material is disclosed which contains a support having coated thereon a red-sensitive silver halide emulsion layer, a non-light-sensitive layer adajcent to the red-sensitive silver halide emulsion layer, and a light-sensitive silver halide emulsion layer adjacent to the non-light-sensitive layer. The non-light-sensitive layer contains substantially non-light-sensitive silver halide grains while the red-sensitive silver halide emulsion layer contains a DIR compound and a particular 2-equivalent substantially colorless cyan coupler.

15 Claims, No Drawings

LIGHT-SENSITIVE SILVER HALIDE COLOR PHOTOGRAPHIC MATERIAL

This invention relates to a light-sensitive silver halide color photographic material, in particular to a light-sensitive silver halide photographic material which is highly sensitive and particularly excellent in image qualities such as granularity, contrast, sharpness, color reproduction, preservation stability, fogging, etc. More particularly, this invention relates to a light-sensitive silver halide color photographic material in which the speed of an image formed in a red-sensitive light-sensitive layer is particularly high and at the same time the image quality thereof is also particularly excellent.

It is strongly desired in this art to provide a light-sensitive silver halide color photographic material having a higher speed and excellent image qualities. It is well-known in the art, however, that a rapid improvement in the speed of a light-sensitive silver halide photographic material is not expected as easy. In prior art teachings, a simple increase in the speed usually causes degradation in the image qualities (for example, granularity). In particular, in a light-sensitive silver halide multi-layer color photographic material, it is difficult to increase the speed of a light-sensitive silver halide layer positioned in the lower layer part, i.e. the part near the support and to improve the image qualities such as contrast, etc. of the image formed in said layer. There has been developed no satisfactory art in this regard. This is because a diffusion retardation development phenomenum (that is called superposed layer effect) of an aromatic primary amine developing agent during the development is caused in a light-sensitive layer closely positioned to the support of a light-sensitive silver halide multi-layer color photographic material and so said closely positioned layer is adversely affected easily by diffusion of a compound having a development inhibition activity and incorporated in said closely positioned layer or a different layer which diffusion is conducted from the different layer to said closely positioned layer or from a certain area to another area is said closely positioned layer itself, or affected easily by various effects such as optical loss caused during the exposure by a non-light-sensitive layer or light-sensitive layer positioned in the upper part.

As a method of sensitization of a light-sensitive silver halide photographic emulsion, there are known, in general, sensitization by such modification at physical ripening stage as roughening of silver halide granules; chemical sensitization by means of noble metal, sulfur, selenium, reductive sensitizer, etc.; spectrul sensitization; sensitization by means of additional incorporation of silver halide in the form of fine particles into a light-sensitive silver halide photographic emulsion; sensitization by use of a development accelerator; sensitization by means of addition of a solvent for silver halide into a light-sensitive silver halide photographic emulsion; and sensitization by use of a coupler capable of reacting rapidly with an oxidation product of a developing agent, for example, a 2-equivalent coupler. With regard to a blue-sensitive light-sensitive layer and a green-sensitive light-sensitive layer in a light-sensitive silver halide multi-layer color photographic material, results obtained by the combination of the above-mentioned known sensitization methods are satisfactory to some degree, when they are positioned in the upper layer part. However, when a red-sensitive light-sensitive layer exists in the lower layer part, the red-sensitivity has been unsatisfactory even when the above-mentioned known sensitization methods are used alone or in combination. Further, even when the desired sensitization is achieved, there was a drawback that the image quality such as granularity was outstandingly degraded. Particularly, in this art, extensive investigations have been made that both in order to find the sufficient red-sensitivity and the improvement in the image quality by development of a novel cyan coupler having good reactivity. It is the current status, however, that there has been found nothing which can favorably be used practically.

On the other hand, in order to improve the image quality, various methods have been proposed. In particular, recently, with regard to a method comprising addition of a compound which releases during development a development inhibiting compound (referred to hereinafter as "DIR compound") to a light-sensitive silver halide color photographic material, the investigation and its evaluation have positively been effected. As compounds of this type, there are known, for example, "DIR-couplers: Development Inhibitor Releasing Couplers" which release a development inhibiting compound while reacting with an oxidation product of color developing agent to form a developed dye; "DIR-hydroquinone: Development Inhibitor Releasing Hydroquinones;" and "DIR-material: Development Inhibitor Releasing Compounds" which release development inhibiting compounds while reacting with the oxidation product of a color developing agent to form a colorless compound without substantial formation of a developed dye.

However, this method reveals a significant drawback when it is combined with the above-mentioned known sensitization methods, though said method certainly exerts a good effect on the improvement of image qualities. The first drawback is that there are caused intra-image effects which inhibit development of a layer wherein a DIR compound releasing imagewise a development inhibiting compound during the development is used and, when included in a red-sensitive light-sensitive layer, the light-sensitivity of that layer is decreased thereby. This phenomenon is particularly more enhanced, when the diffusibility of development inhibitors released, during the development, from DIR-hydroquinone, DIR-material or DIR-coupler is low. The second drawback is attributable to the inter-image effects according to which a development inhibiting compound diffuses from a certain layer to an upper or lower emulsion layer adjacent thereto, or up to an emulsion layer which is sensitive to a different color of distinguished color tone, whereby exhibiting at that place the development inhibiting effect in conformity with the imagewise distribution in the certain layer, and the following actual drawbacks are, therefore, observed: Although a red-sensitive light-sensitive layer is ordinarily constituted by a plurality of emulsion layers, addition of the above-mentioned compound to one of such emulsion layers will affect the contrast of the adjacent emulsion layer and further decrease even the sensitivity of the red-sensitive light-sensitive emulsion layer. At the same time, even the sensitivity of an emulsion layer sensitive to a different color is also decreased. Alternatively when the above-mentioned compound is added to a different color-sensitive emulsion layer, the sensitivity of the red-sensitive light-sensitive layer will contrary be decreased. This phenomenon becomes more apparent when the development inhibitor released during the development is a halogen ion or an organic heterocyclic compound which shows high diffusibility.

Consequently, in view of the above-mentioned drawbacks, the amount of DIR compound to be used wil naturally be limited. This means that the method recently proposed is impossible even when it is combined with either known sensitization method as mentioned hereinbefore to attain the desired sensitization effect. Furthermore, the improvement in the image quality attainable thereby will also be unsatisfactory.

Under these circumstances, there has been proposed a method to improve the above-mentioned drawbacks of the methods using said DIR compounds. For example, there is proposed a method which comprises arranging to a red-sensitive light-sensitive layer containing a DIR compound, a non-light-sensitive layer adjacent thereto and incorporating into said non-light-sensitive layer an adsorptive colloid layer (containing silver halide particles which are not developed or low in the light-sensitivity) iof a development inhibiting compound. This non-light-sensitive layer containing silver halide particles is in fact effective in decreasing or limiting the influence of the development inhibitor released from each of the light-sensitive silver halide color layers. However, when the non-light-sensitive layer containing silver halide particles is arranged according to the above-proposed method in adjacency to the red-sensitive light-sensitive layer, further serious disadvantages such as increase in fogging and degradation in preservation properties with passage of time will be caused although the sensitivity of the red-sensitive light-sensitive layer may not be decreased so much degree. This will be a fatal disadvantage which lowers the commercial value of a light-sensitive photographic material.

Thus, it is a current status that according to the methods known heretofore, high speed of the red-sensitive light-sensitive layer in a light-sensitive multi-layer color photographic material and excellent image qualities have not been achieved sufficiently. Therefore, the first object of this invention is to provide a light-sensitive silver halide color photographic material in which the sensitivity of the red-sensitive light-sensitive layer is particularly high.

The second object is to provide a light-sensitive silver halide color photographic material excellent in the image qualities.

The third object is to provide a light-sensitive silver halide color photographic material in which the superposed layer effect is controlled.

The fourth object is to provide a light-sensitive silver halide color photographic material excellent in fogging properties.

The fifth object is to provide a light-sensitive silver halide color photographic material excellent in preservation properties.

The sixth object is to provide a light-sensitive silver halide color photographic material which satisfies all the objects as mentioned above.

The seventh object is to provide a process for the preparation of a light-sensitive silver halide color photographic material satisfying all the objects as mentioned above. Other objects of this invention will be apparent from the description referred to hereinafter.

The objects as mentioned above are achieved by use of a light-sensitive silver halide color photographic material comprising, on a support, i) the first light-sensitive silver halide layer, ii) a non-light-sensitive layer adjacent to said first light-sensitive layer and iii) the second light-sensitive silver halide layer adjacent to said non-light-sensitive layer, by incorporating into the first light-sensitive silver halide layer a) a compound which releases a development inhibitor by the reaction with a) 2-equivalent cyan coupler which is substantially colorless and represented by general formula [I] or [II] as given below and b) the oxidation product of an aromatic primary amine developing agent and by incorporating into the non-light-sensitive layer silver halide grains which are substantially non-light-sensitive.

$$Cp - Y \qquad [I]$$

and $$Cp - X - Cp \qquad [II]$$

in which Cp represents a residue formed by removing one hydrogen atom at the active point of a cyan coupler; Y represents $-OR_1$ or

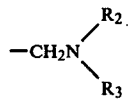

(wherein $R_1$, $R_2$ and $R_3$ individually represent a monovalent group, or $R_2$ and $R_3$ may co-operatively form a heterocyclic ring), or $-NHCOR_4$ or $-NHSO_2R_4$ (wherein $R_4$ represents an aliphatic hydrocarbon residue, an alicyclic hydrocarbon residue, an aromatic hydrocarbon residue or a heterocyclic ring) and X represents $-O-X_1-O-$,

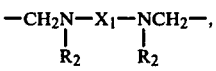

$-NHCO-X_1-CONH-$ or $-NHSO_2-X_1-SO_2NH-$ (wherein $R_2$ has the same meaning as above and $X_1$ represents a divalent group).

In this invention, the 2-equivalent cyan coupler to be included into the first light-sensitive layer is represented by general formula [I] or [II] as mentioned above. The 2-equivalent cyan coupler of general formula [I] or [II] will be explained below in detail.

In the general formula [I] and [II], $R_1$, $R_2$ and $R_3$ each are a monovalent group and the typical monovalent groups include an alkyl group (for example, methyl, ethyl, n-propyl, iso-propyl, n-butyl, iso-butyl, tert.-butyl, n-hexyl, n-octyl, n-dodecyl, etc.), an alkenyl group (for example, ethenyl, allyl, octenyl, etc.), an aryl group (for example, phenyl, naphthyl, etc.), a heterocyclic ring (for example, morpholino, piperazyl, imidazolyl, furyl, imidazolinyl, tetrazolyl, pyrimkdinyl, pyrrolyl, pyrrolidinyl, tetrazolyl, thiazinyl, thiazolinyl, thiazolyl, thienyl, etc.), an acyl group (for example, acetyl, propionoyl, butyroyl, octanoyl, benzoyl, cinnamoyl, etc.), a carbamoyl group (for example, carbamoyl, methylcarbamoyl, ethylcarbamoyl, butylcarbamoyl, octylcarbamoyl, phenylcarbamoyl, etc.), a sulfamoyl group (for example, methylsulfamoyl, ethylsulfamoyl, propylsulfamoyl, hexylsulfamoyl, phenylsulfamoyl, etc.) and a sulfonyl group (for example, methylsulfonyl, ethylsulfonyl, octylsulfonyl, benzenesulfonyl, etc.)

Further, $R_2$ and $R_3$ may cooperatively form a heterocyclic ring which may contain, in addition to the one nitrogen, oxygen, sulfur and/or two or more nitrogen.

Typical examples of the heterocyclic ring include imidazolidinyl, imidazolinyl, imidazolyl, morpholino, oxazolidinyl, piperidino, pyrazinyl, pyrazolidinyl, pyrazolinyl, pyrazolyl, pyrrolyl, pyrrolidinyl, pyrrolinyl, tetrazolyl, thiazolidinyhl, triazolidinyl, triazolyl, etc.

The groups and rings in the above-mentioned general formulas include the substituted. Although the substituents may be any substituents, prefered ones are one or more appropriately selected from the group consisting of halogen, nitro, cyano, amino, hydroxy, carboxy, an amino group, an alkyl group, an alkenyl group, an aryl group, an alkoxy group, an alkenyloxy group, an aryloxy group, an arylazo group, an acylamino group, a carbamoyl group, an acyl group or an ester group.

In the present invention, $R_1$ is preferably a group of the formula $$-(L_1)_t-\{R_5-L_2-(R_6-O)_u\}_v R_7$$

wherein $L_1$ represents —$SO_2$—, —CO—, —CONH— or —CONHCO— or —$CONHSO_2$— (in the latter two divalent groups, the carbon atoms therein are attached to the oxygen atom to which $R_1$ is attached); $L_2$ represents —CO—, —COO—, —O—, —$SO_2$—, —NH-CO—, —$NR_7'$CO— (where $R_7'$ represents a lower alkyl group having 1–4 carbon atoms), —OCO— or —CONH—, with the proviso that in the group represented by $L_2$, the bond of left-hand is attached to the oxygen to which $R_1$ is attached; $R_5$ and $R_6$ each represent an alkylene group (of 1–4 carbon atoms), a phenylene group, or an $\alpha$- or $\beta$-naphthylene group. The groups appeared in the $R_5$ and $R_6$ include the substituted. Although the substituents may be any substituents, prefered ones are one or more appropriately selected from the group consisting of bromine, fluorine, chlorine, nitro, hydroxy, a lower alkoxy group, a carboxyl group or a sulfo group; $R_7$ represents an alkyl group of 1–4 carbon atoms, a phenyl group, a naphthyl group, a phenylalkyl group or an alkylphenyl group of 7–10 carbon atoms, a naphthylalkyl group or an alkylnaphthyl group of 11–14 carbon atoms or a heterocyclic ring. The group of $R_7$ include the substituted. Although the substituents may be any substituents, preferred ones are one or more appropriately selected from the group consisting of halogen, nitro, a lower alkoxy group, a lower alkylcarboxamido group, a carboxy group and/or sulfo groups; t and v each represent an integer of 0 or 1 and u represents an integer of 0, 1, 2 or 3.

In the present invention, $R_2$ and $R_3$ are preferably an alkyl group or an arylalkyl group, respectively.

$X_1$ represents a divalent group, and preferably a group of the formula $$-(J_3)_\omega-X_2\{J_1\{X_3\{J_2\{J_2 X_3\}_z J_1\}_y-X_2\}_x-(J_3)_\omega-$$

wherein, x, y and z each represent an integer of 0 or 1; $\omega$ is an integer of 0 or 1, when $X_1$ is attached to oxygen and in other case, $\omega$ is 0; $J_1$ and $J_2$ each represent —S—, —O—, $$-\overset{O}{\overset{\|}{C}}-,\ -\overset{O}{\overset{\|}{C}}-O-,\ -O\overset{O}{\overset{\|}{C}}-,$$

—SO—, —$SO_2$—, —NHCO—, —CONH—, $NHSO_2$ or —$SO_2NH$—, with the proviso that the divalent group represented by $J_1$ is attached to $X_2$ through the bond of left-hand, said group of the formula —CONH—, —CO—, —$SO_2$— or —O— being preferabely in this invention; and $J_3$ represents —$SO_2$—, —CONH— (wherein the nitrogen is attached to $X_2$) or —CO—.

$X_2$ and $X_3$ are each a divalent group and typical examples of the preferable divalent group include an alkylene group (for example, methylene, ethylene, trimethyene, hexamethylene, octamethylene, propylene, butylene, octylene, etc.), an arylene group (for example, phenylene, naphthylene, etc.), an aralkylene group (for example, tolylene, benzilidene, xylylene, etc.), an arylenealkylene group, and a divalent heterocyclic ring (for example, a 2,4-pyrimidine residue). The groups and ring of $X_2$ and $X_3$ include the substituted. Although the substituents may be any substituents, prefered ones are one or more appropriately selected from the group consisting of the substituents of $R_1$, $R_2$ and $R_3$.

For $R_4$, examples of the aliphatic hydrocarbon residue include an alkyl group (for example, methyl, ethyl, n-propyl, isopropyl, n-butyl, iso-butyl, tert.-butyl, n-hexyl, n-octyl, n-dodecyl, etc.), an alkenyl group (for example, ethenyl, allyl, octenyl, etc.) and examples of the alicyclic hydrocarbon include cyclopentyl, cyclohexyl, cycloheptyl, cyclohexenyl, cyclohexadienyl and terpenyl (e.g. bornyl and norbornyl, etc.). Further, as the aromatic hydrocarbon residue, an aryl group (for example, phenyl, naphthyl, etc.) is included as the typical example. Furthermore, examples of heterocyclic ring include, for example, morpholino, piperazyl, imidazolyl, furyl, imidazolidinyl, tetrazolyl, pyrimidinyl, pyrrolyl, pyrrolidinyl, tetrazolyl, thiazinyl, thiazolinyl, thiazolyl, thienyl, etc. The groups, ring and residues of the $R_4$ include the substituted as explained before. Although the substituents may be any substituents prefered ones are one or more appropriately from the group consisting of the substituents of $R_1$, $R_2$ and $R_3$.

In the present invention, $R_4$ is preferably an alkyl group or an aryl group and more preferably individually halogen-substituted alkyl having 1–15 carbon atoms, a phenyl or $\alpha$-naphthyl group. Said phenyl or naphthyl group includes, in addition to unsubstituted phenyl or naphthyl, one substituted by one or more substituents of halogen, nitro, lower alkyl, lower alkoxy, lower alkyl carboxamido, carboxyl, sulfo and/or lower alkyl groups. $X_1$ is a divalent group, and typical examples of the divalent group include an alkylene group (for example, methylene, ethylene, trimethylene, hexamethylene, octamethylene, propylene, butylene, octylene, etc.), an arylene group (for example, phenylene, naphthylene, etc.) an aralkylene group (for example, tolylene, benzylidene, xylylene, etc.) and sulfonyl groups. These divalent groups include the substituted. Preferred substituents are one or more appropriately selected from the groups consisting of the substituents as those defined for $R_1$, $R_2$ and $R_3$.

The Cp in general formulae [I] and [II] represents the residue of a cyan coupler formed by removing a split-off group, the cyan coupler residue including not only that containing one active point in the molecule but also, a so-called polyfunctional cyan coupler residue containing two or more active points in the molecule. When the cyan coupler residue is a residue formed by removing one hydrogen at the active point of the polyfunctional coupler, the hydrogen at the other active points in the molecule may be unsubstituted or substituted by active point substituents of the present invention or other active point substituents. As the cyan coupler residue, there are included, for example, a phenol cyan coupler residue, an α-naphthol cyan coupler residue and a pyrazolo-quinosolone cyan coupler residue. Further, more illustratively, a cyan coupler residue of the following general formula [III], [IV] or [V] is useful as the cyan coupler residue:

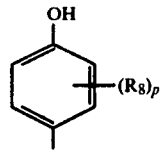

(III)

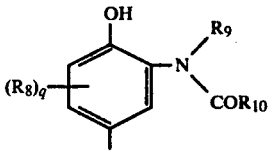

(IV)

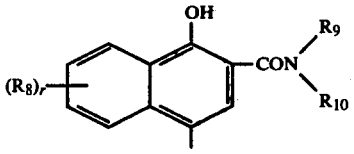

(V)

in which $R_8$, $R_9$ and $R_{10}$ each represent a group used in an ordinary 4 equivalent type phenol or α-naphthol coupler and more concretely, hydrogen, halogen, an aliphatic hydrocarbon residue, an acylamino group, —O-$R_{11}$ or —S-$R_{11}$ (where $R_{11}$ represents an aliphatic hydrocarbon residue) is included as $R_8$ and when two or more $R_8$ groups are present in the same molecule, such two or more $R_8$ groups being able to be different; as $R_9$ and $R_{10}$, a group selected from an aliphatic hydrocarbon residue, an aryl group and a heterocyclic ring is included, or one of $R_9$ and $R_{10}$ may be a hydrogen and those groups containing an additional substituent thereon are also included, and $R_9$ and $R_{10}$ may cooperatively form a nitrogen-containing heterocyclic ring; P represents an integer of 1 to 4; q represents an integer of 1 to 3 and r represents an integer of 1 to 5. Said aliphatic hydrocarbon residue may be saturated or unsaturated, straight, branched or cyclic, and is preferably an alkyl group (for example, methyl, ethyl, propyl, isobutyl, octyl, dodecyl, octadecyl, cyclobutyl, cyclopentyl, cyclohexyl, etc.), an alkenyl group (for example, allyl, octenyl, etc.) or a terpenyl group (for example, norbonyl). As the aryl group, a phenyl group or a naphthyl group is included, and as the heterocyclic ring, morpholino, piperazyl, pyridinyl, furyl, quinolyl, pyrrolyl, pyrrolidinyl, thienyl, piperidyl, tetrazolyl, thiazinyl, thiazolinyl, imidazolyl, oxazolyl, imidazolidinyl, benzoxazolyl, benzimidazolyl, benzothiazolyl, etc. are typical. The groups, rings and residue in general formulas [III], [IV] and [V] include the substituted. Although the substituents may be any substituents, prefered ones are one or more appropriately selected from the group consisting of halogen, nitro, hydroxy, carboxy, an amino group, sulfo, an alkyl group, an alkenyl group, an aryl group, a heterocyclic ring, an alkoxy group, an aryloxy group, an arylthio group, an arylazo group, an acylamino group, a carbamoyl group, an ester group, an acyl group, an acyloxy group, a sulfonamido group, a sulfamoyl group, a sulfonyl group, a morpholino group, etc.

More concretely, there are useful such cyan coupler residues as described in U.S. Pat. Nos. 2,423,730; 2,474,293; 2,801,171; 2,895,826; 3,476,563; 3,737,316; 3,758,308 and 3,839,044.

Preferably cyan couplers used in this invention are those of general formula [I] in which Y represents —O-$R_1$ and those of general formula [II] in which X represents —O-$X_1$-O— (particularly preferably a coupler having —O$R_1$).

Typical examples of the split-off groups according to this invention are as follows:

| | |
|---|---|
| $-OCONHCH_3$ | $-OCONHC_2H_5$ |
| 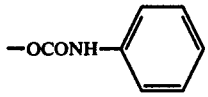 | 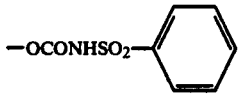 |
| $-OCONHCH_2CH_2NHCOO-$ | 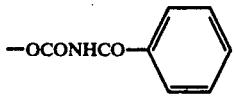 |
| $-OCH_2COCH_3$ | $-OCH_2COOC_2H_5$ |
| $-OCH_2CONHCH_2CH_2OCH_3$ | $-OCHCOOC_2H_5$ $\vert$ $C_2H_5$ |
| 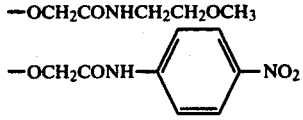 | $-OCH_2COOH$ |
| 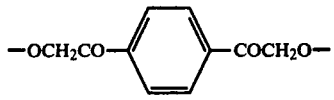 | |
| $-OCH_2CONHCH_2CH_2OH$ | $-OCH_2CONHC_3H_7(i)$ |

-continued
$-OSO_2CH_3$
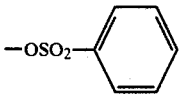
$-OSO_2CH_2CH_2SO_3-$
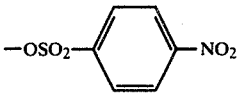
$-OCOOCH_3$
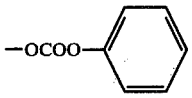
$-OCOCH_3$
$-OCH_2CH_2Cl$
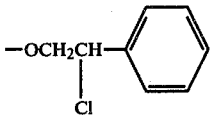
$-OCH_2CF_3$
$-OCH_2C_2F_4H$
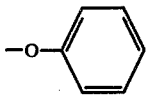
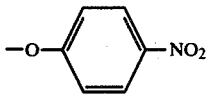
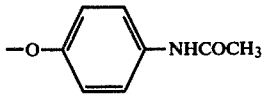
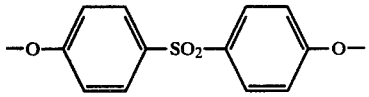
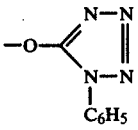
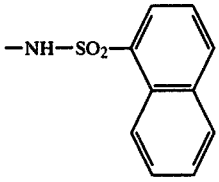
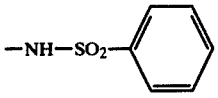
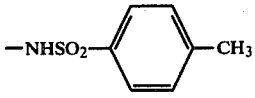
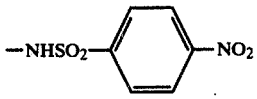
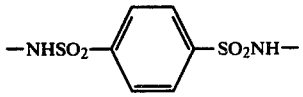
$-NHSO_2CH_2CH_2SO_2NH-$
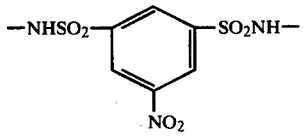
$-NHCOCCl_3$
$-NHCO(C_2F_4)_2H$
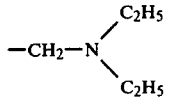
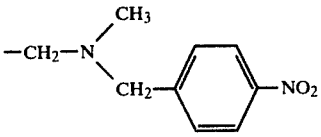
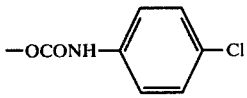

-continued
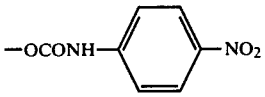
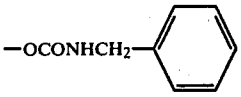
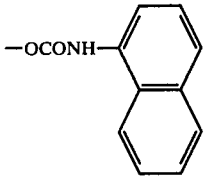
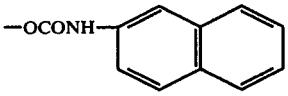
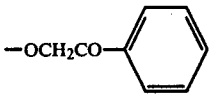
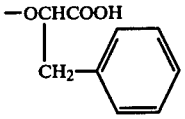
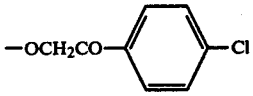
$-OCH_2COCH_2CH_2COOH$
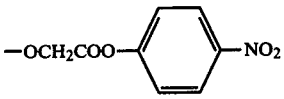
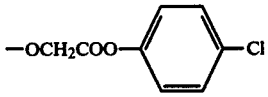
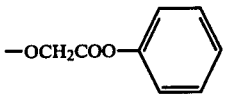
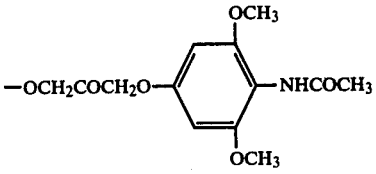
$-OCHCOOCH_2CH_2OCH_3$
$CH_3$
$-OCH_2COO(CH_2CH_2O)_2CH_3$
$-OCH_2COOCH_2COOH$
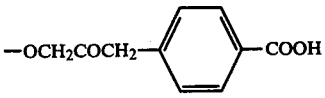
$-OCH_2CONHC_2H_5$
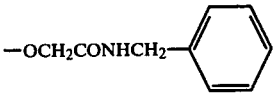
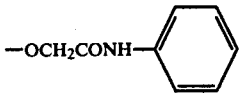
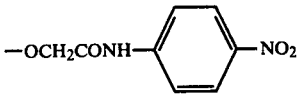
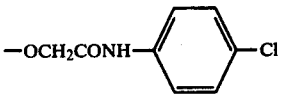
$-OCH_2CONHCH_2CH_2CH_2OH$
$-OCH_2CONHCH_2CH_2CH_2OCH_3$
$-OCH_2CONH(CH_2CH_2O)_3C_2H_5$
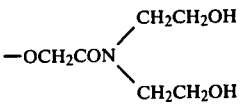
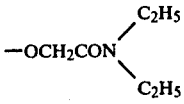

-continued

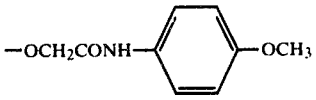

$-OCH_2CONH-C_6H_4-OCH_3$

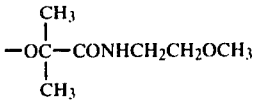

$-OC(CH_3)_2-CONHCH_2CH_2OCH_3$ $-OCH_2CONHCH_2CH_2COOH$ $-OCH_2CONHCH_2COOH$

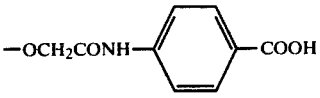

$-OCH_2CONH-C_6H_4-COOH$ $-OCH_2CONHCH(CH_2COOH)COOH$

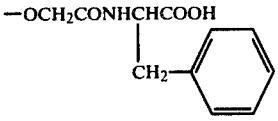

$-OCH_2CONHCH(CH_2-C_6H_5)COOH$ $-OCH(CH_3)COOH$ $-OCH(C_2H_5)COOH$ $-OCH_2CONHCH_2CH_2OCH_2CH_2NHCOCH_2O-$
$-OCH_2CONHCH_2CH_2NHCOCH_2O-$ $-OSO_2C_2H_5$

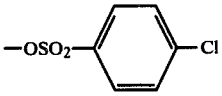

$-OSO_2-C_6H_4-Cl$

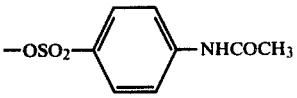

$-OSO_2-C_6H_4-NHCOCH_3$

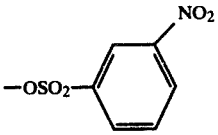

$-OSO_2-C_6H_4-NO_2$

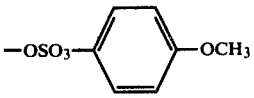

$-OSO_3-C_6H_4-OCH_3$

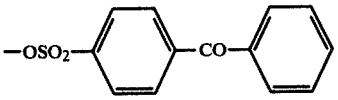

$-OSO_2-C_6H_4-CO-C_6H_5$

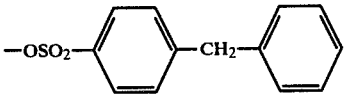

$-OSO_2-C_6H_4-CH_2-C_6H_5$

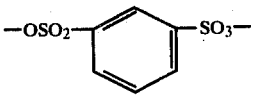

$-OSO_2-C_6H_4-SO_3-$ $-OCH_2CCl_3$ $-OCH_2CH_2CH_2Cl$ $-OCH_2CH_2Br$ $-OCH_2CHBrCH_2Br$

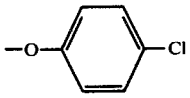

$-O-C_6H_4-Cl$

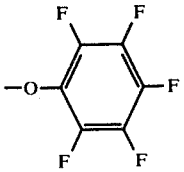

$-O-C_6H_2F_4$

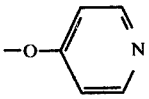

$-O-C_5H_3N$

-continued
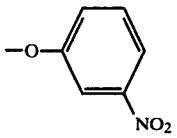
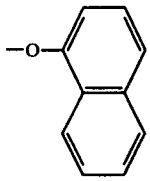
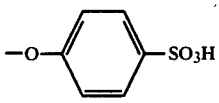
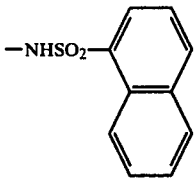
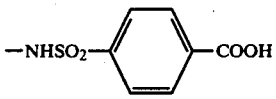
$NHSO_2CH_3$
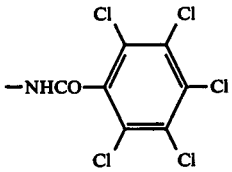
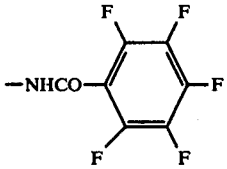
$-NHCOC_2F_4H$
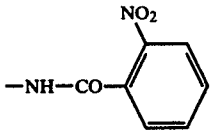
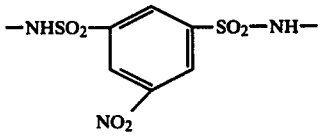
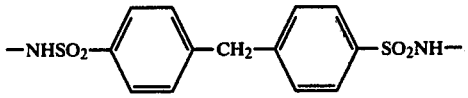
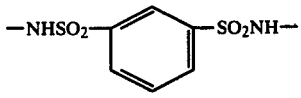
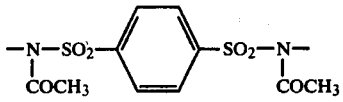
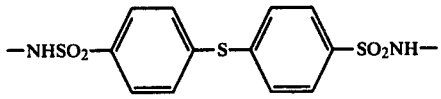
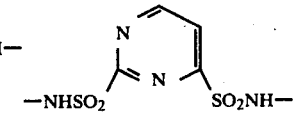
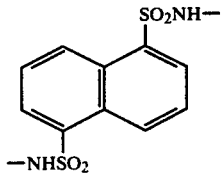
Further, typical cyan couplers according to this invention will be exemplified below, but the cyan couplers to be used in this invention should not be limited thereto.

Exemplified Compounds:

(C-1) 1-hydroxy-4-anilinocarbonyloxy-N-[δ-(2,4-di tert.-amylphenoxy)butyl]-2-naphthamide (C-2) 1,2-bis-{4-hydroxy-3-[N-[δ-(2,4-di-tert.-amylphenoxy)butyl]carbamoyl]-1-naphthyloxy-carbamino}ethane (C-3) 1-hydroxy-4-(ethoxycarbonylmethoxy)-N-[δ-(2,4-di-tert.-amyl)butyl]-2-naphthamide (C-4) 1-hydroxy-4-(β-methoxyethylamino-carbonyl-methoxy)-N-[δ-(2,4-di-tert.-amylphenoxy)-butyl]-2-naphthamide (C-5) 2-chloro-3-methyl-4-carboxymethoxy-6-[β-(2,4-di-tert.-amylphenoxy)butyroylamino]-phenol (C-6) 1-hydroxy-4-(4-nitrobenzenesulfonyloxy)-N-[δ-2,4-di-tert.-amylphenoxy)butyl]-2-naphthamide (C-7) 1-hydroxy-4-methoxycarbonyloxy-N-dodecyl-2-naphthamide (C-8) 1-hydroxy-4-acetoxy-N-[δ-(2,4-di-tert.-amylphenoxy)butyl]-2-naphthamide (C-9) 1-hydroxy-4-(2-chloroethoxy)-N-(2-n-tetra-decyloxyphenyl)-2-naphthamide (C-10) 1-hydroxy-4-(2,2,3,3-tetrafluoropropyloxy)-N-]δ-(2,4-di-tert.-amylphenoxy)butyl]-2-naphthamide (C-11) 1-hydroxy-4-(4-nitrophenoxy)-N-[δ-(2,4-dii-tert.-amylphenoxy)butyl]-2-naphthamide (C-12) 1-hydroxy-4-(1-phenyl-5-tetrazolyloxy)-N [δ-(2,4-di-tert.-amylphenoxy)butyl]-2-naphthamide (C-13) 1-hydroxy-4-(4-toluenesulfonamido)-N-[δ-(2,4-di-tert.-amylphenoxy)butyl]-2-naphthamide)-1-

(C-14) 1,2-bis[4-hydroxy-3-(n-dodecylcarbamoyl)-1-naphthylsulfamoyl]ethane (C-15) 1-hydroxy-4-trichloroacetamido-N-[δ-(2,4-di-tert.-amylphenoxy)butyl]-2-naphthamide (C-16) 1-hydroxy-4-(N-methyl-N-(4-methyl-N-(4-nitrobenzyl-)amino-methyl]-N-[δ(2,4-di-tert.-amylphenoxy)butyl]-2-naphthamide (C-17) 1-hydroxy-4-(4'-chloroanilinocarbonyloxy)-N-dodecyl-2-naphthamide (C-18) 1-hydroxy-4-benzylaminocarbonyloxy-N-[δ-(3-n-dodecyloxyphenoxy)butyl]-2-naphthamide (C-19) 1-hydroxy-4-(1-naphthylaminocarbonyloxy)-N-[δ-(2,4-di-tert.-amylphenoxy)butyl]-2-naphthamide (C-20) 1-hydroxy-4-benzoylmethoxy-N-[δ-(2,4-di-tert.-amylphenoxy)butyl]-2-naphthamide (C-21) 1-hydroxy-4-(4-nitrophenoxycarbonylmethoxy)-N-[δ-(2,4-di-tert.-amylphenoxy)butyl]-2-naphthamide (C-22) 1-hydroxy-4-benzylaminocarbonylmethoxy-N-[δ-(3-n-dodecyloxyphenoxy)butyl)-2-naphthamide (C-23) 1-hydroxy-4-(β-(β-methoxyethoxy)ethoxy-carbonylmethoxy]-N-[δ-(2,4-di-tert.-amyl-phenoxy)butyl)-2-naphthamide (C-24) 1-hydroxy-4-(α-(β-methoxyethoxycarbonyl)ethoxy]-N-[δ-(2,4-di-tert.-amylphenoxy)butyl]-2-naphthamide (C-25) 1-hydroxy-4-(β-hydroxyethylamino-carbonyl-methoxy)-N-[-δ-2,4-di-tert.-amylphenoxy)butyl)-2-naphthamide (C-26) 1-hydroxy-(γ-hydroxypropylamino-carbonyl-methoxy)-N-n-dodecyl-2-naphthamide (C-27) 1-hydroxy-4-(di-β-hydroxyethyl-aminocarbonyl-methoxy)-N-(2-tetradecyloxyphenyl)-2-naphthamide (C-28) 1-hydroxy-4-carboxymethoxy-N-[δ-(2,4-di-tert.-amylphenoxy)butyl)-2-naphthamide (C-29) 2-tetrafluoropropionylamino-4-(α-carboxy-propyloxy)-5-[β-(2,4-di-tert.-amylphenoxy)-butyroylamino]phenol (C-30) 1-hydroxy-4-(β-carboxyethylaminocarbonyl-methoxy)-N-(2-tetradecyloxyphenyl)-2-naphthamide (C-31) bis-[β-(1-hydroxy-2-N-n-dodecylcarbamoyl-4-naphthoxyacetyl)aminoethyl]ether (C-32) 1-hydroxy-4-methylsulfonyloxy-N-[δ-(2,4-di-tert.-amylphenoxy)butyl]-2-naphthamide (C-33) 1-hydroxy-4-(4-acetylaminobenzenesulfonyloxy)-N-[δ-(2,4-di-tert.-amylphenoxy)butyl]-2-naphthamide -continued (C-34) 1,3-bis-{1-hydroxy-2-[N-(δ-2,4-di-tert.-amylphenoxy)butylcarbamoyl]-4-naphthyloxy-sulfonyl}-benzene (C-35) 1-hydroxy-4-(2,2,2-trichloroethoxy)-N-[3-(2,4-di-tert.-amylphenoxyacetamido)propyl]-2 naphthamide (C-36) 1-hydroxy-4-(pentafluorophenoxy)-N-[β-{4-[α-(2,4-di-tert.-amylphenoxy)acetamido]phenyl} ethyl]-2-naphthamide (C-37) 1-hydroxy-4-(4-pyridyloxy)4'-(4-tert.-butyl-phenoxy)-2-naphthanilide (C-38) 1-hydroxy-4-(4-sulfophenoxy)-N-octadecyl-2-naphthamide sodium salt (C-39) 1-hydroxy-4-(4-carboxyphenylsulfonamide)-N-[δ-(2,4-di-tert.-amylphenoxy)butyl]-2-naphthamide (C-40) 1-hydroxy-4-phenylsulfonamido-N-n-dodecyl-2-naphthamide (C-41) 1-hydroxy-4-pentafluorobenzamido-N-[δ-(2,4-di-tert.-amylphenoxy)butyl]-2-naphthamide (C-42) 5-nitro-1,3-bis-[1-hydroxy-2-{N-[δ-2,4-di-tert.-amylphenoxy)butyl]carbamoyl}-4-naphthyl-sulfamoyl]benzene (C-43) 1,3-bis-[1-hydroxy-2-{N-(γ-(2,4-di-tert.-amylphenoxyacetamino)propyl]carbamoyl}-4-naphthylsulfamoyl)benzene The cyan couplers used in this invention can easily be prepared according to the descriptions of the references referred to hereinbefore with regard to the cyan coupler residues.

The compound used in this invention, which releases a development inhibitor by a reaction with an oxidation product of an aromatic primary amine developing agent (i.e. a DIR compound) will be grouped into a so-called DIR coupler which forms a colored dye by a reaction with an oxidation product of an aromatic primary amine developing agent; a so-called DIR hydroquinone; and a DIR substance forming a colorless compound.

As the DIR couplers to be used in this invention, the compounds of the following general formulae [VI], [VII] and [VIII] are useful:

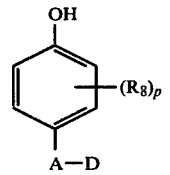

(VI)

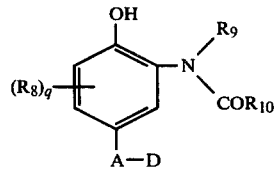

(VII)

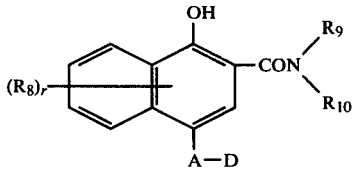

(VIII)

in which $R_8$, $R_9$, $R_{10}$, p, q and r are individually as defined for general formulae [III], [IV] and [V]; A represents sulfur or selenium and D represents a group which forms together with the sulfur or selenium of the thioether bond or selenoether bond, when said atom is split-off, a compound possessing the development inhibiting action. Typical examples of D include an aryl group and a heterocyclic ring. Typical examples of such group in which D and the sulfur or the selenium are connected, include, when A is sulfur, a heterocyclic mercapto compound residue, for example, a mercaptotetrazole group (particularly 1-phenyl-5-mercaptotetrazole, 1-nitrophenyl-5-mercaptotetrazole, 1-naphtyl-5-mercaptotetrazole), a mercaptothiazole group (in particular, 2-mercaptobenzthiazole, mercaptonaphthothiazole), a mercaptooxadiazole group, a mercaptopyrimidine group, a mercaptooxazole group, a mercaptothiadiazole group, a mercaptotriazine group and a mercaptotriazole group, and as the residue of an arylmercapto group, for example, a mercaptobenzene group (particularly, 1-mercapto-2-benzoic acid, 1-mercapto-2-nitro-benzene, 1-mercapto-3-heptadecanoylaminobenzene) are included.

When A is selenium, as the heterocyclic seleno group, for example, 1-phenyl-5-selenotetrazole, 2-selenobenzoxazole and 2-selenobenzthiazole are included and as an arylseleno group, for example, a seleno-benzene group [for example, 4-(4-hydroxyphenylsulfonyl)selenophenol] are included. Concrete exemplification of the DIR coupler used in this invention is, for example, in U.S. Pat. Nos. 3,227,554 and 3,773,201 and the process for the preparation thereof is also described therein. As the DIR hydroquinones used in this invention, the compounds of the following general formula [IX] are included:

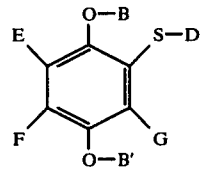

(IX)

wherein E, F and G each represent a hydrogen, an alkyl group (for example, an alkyl having 1–20 carbon atoms, e.g. methyl, ethyl, propyl, butyl, amyl, octyl, decyl, dodecyl, tridecyl, eicosyl, etc.), hydroxy, an alkoxy group (for example, methoxy, ethoxy, butoxy, octyloxy, etc.), an amino group, an alkylthio group (for example, nonylthio, tridecylthio, etc.), a halogen, a heterocyclic ring (for example, tetrazolyl, oxazolyl, imidazolyl, thiazolyl, quinolinyl, etc.), and —S-D (which is the same as —S-D contained in the general formula [XI]), further E and F may be cyclized together to form a hydrocarbon ring; D represents the same group as that defined for the general formulae [VI], [VII] and [VIII] wherein A is sulfur. B and B' are each preferably a hydrogen but may be such group as being able to be split-off under alkaline condition, for example, an acyl group, an alkoxycarbonyl group or an alkoxyoxalyl group.

DIR hydroquinones do not release a development inhibitor by coupling with an oxidation product of a developing agent unlike DIR couplers or DIR substances, but release a development inhibitor by a mutual oxidation with the oxidation product of the developing agent. However, there is no difference between DIR hydroquinone and DIR coupler or DIR substance with regard to the fact that the development is inhibited by the reaction with the oxidation product of the developing agent.

Concrete exemplification of DIR hydroquinone is mentioned, for example, in U.S. Pat. Nos. 3,639,417 and 3,379,529 together with the process for the preparation thereof.

The DIR substance is equivalent to the DIR coupler in respect that it causes the coupling reaction with the oxidation product of a developing agent, but different from the DIR coupler, it does not form dye image substantially.

As the DIR substance to be used in this invention, the compounds of the following general formulae [X], [XI] and [XII] are useful:

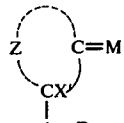

(X)

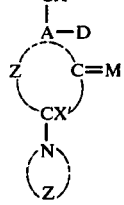

(XI)

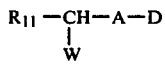

(XII)

In the above formulae [X], [XI] and [XII], X' represents hydrogen or halogen and Z represents a non-metal atomic group necessary for forming a hydrocarbon ring or a heterocyclic ring. As the hydrocarbon ring in Z, for example, a saturated or unsaturated 5- to 7-membered hydrocarbon ring is included. More illustratively, a cyclopentane ring, cyclohexane ring, cycloheptane ring, cyclopentane ring, cyclohexene ring, cycloheptene ring and cyclohexadiene ring are typical. Further, said hydrocarbon ring may form at an appropriate position a fused ring typical example of which are, for example, indane, benzcyclohexane, benzcycloheptane, etc.

The heterocyclic ring in the Z is, for example, a 5- to 7-membered heterocyclic ring containing nitrogen, oxygen and/or sulfur. More concretely, when M is oxygen, a group which forms together with the carbonyl group such heterocyclic ring as piperidone (for example, 2-piperidone, 3-piperidone, 4-piperidone), lactone (for example, 4 to 7-membered lactone), lactam (for example, pyrrolidone), hydantoin, indole (for example, oxyindole), etc. is typical.

M represents oxygen or N-L, L represents a hydroxy or an amino group. Typical an amino groups include amino, a phenylamino, ureido, phenylureido and thioureido.

In general formula XI, Z' represents an non-metal atomic group which forms, together with the nitrogen caused when the C-N linkage is cleavaged, a heterocyclic ring possessing the before-mentioned development inhibiting effect, and includes concretely a benztriazole group (for example, 5-methylbenztriazole, 5-bromobenztriazole, 5-octadecanamidobenztriazole, 5-benzyloxybenztriazole, etc.), a naphthotriazole group, an indazole group (for example, 4-nitroindazole), a pyrazol group, a thiohydantoin group and a rhodanine group.

Concrete exemplification of the compounds of the general formula [X] and [XI] is in U.S. Pat. Nos. 3,958,993, 3,961,959 and 3,938,996 as well as the syntheses thereof.

In general formula [XII], $R_{11}$ represents —COR', —$CONH_2$, —CONHR',

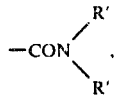

$-SO_2-R'$, $-SO_2-OR'$,

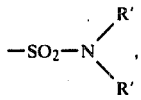

$-COOR'$,

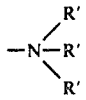

or —CN, in which an alkyl group for R′ is, for example, a saturated alkyl group having 1–18 (preferably 1–5) carbon atoms (for example, methyl, ethyl, propyl, butyl, amyl, etc.), an unsaturated alkyl group (for example, ethenyl, allyl, etc.)

An aryl group is preferably a phenyl group or a naphthyl group. A 5- or 6-membered heterocyclic ring comprises hetero atoms such as nitrogen, oxygen and/or sulfur, such heterocyclic ring may be fused with benzene ring or naphthalene ring. Further, when two or more R′s are contained as in the group

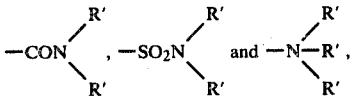

two nitrogen may form together with the nitrogen a nitrogen-containing heterocyclic ring (for example, piperidine, pyrrolidine and morpholine rings).

In general formula [XII], W represents hydrogen; an alkyl group (preferably an alkyl group having 1–18 carbon atoms); an aryl group (preferably phenyl or naphthyl which both may be substituted with an alkyl having 1–18 carbon atoms, alkoxy, halogen, nitro or cyano group); a 5- or 6-membered heterocyclic ring [which contains at least one hetero atom such as nitrogen, oxygen or sulfur, and may be fused with a benzene or naphthalene ring (forming, for example, benzoxazole, benzthiazole, etc.)], —A-D (these groups being as defined for general formula [VI], [VII] and [VIII]), halogen (for example, chlorine, bromine), an alkoxy group (preferably having 1–5 carbon atoms), an aryloxy group (the aryl group being preferably phenyl group or naphthyl group); a heteroaryloxy group (wherein the heteroaryl group is a 5- or 6-membered heterocyclic group containing at least one hetero atom such as nitrogen, oxygen or sulfur, and the heterocyclic ring may be fused with a benzene or naphthalene ring); or an acyloxy group (wherein, for example, the acyl group represents an aliphatic acyl such as acetyl, propioroyl, palmitoyl, etc. or aromatic acyl such as benzoyl, etc.).

The groups, rings and residues appeared in all general formulas [VI], [VII], [VIII], [IX], [X], [XI] and [XII] include the substituted. Although the substituents may be any substituents, prefered ones are one or more appropriately selected from the group consisting of halogen, nitro, cyano, sulfo, hydroxy, carboxy, an alkyl group, an alkenyl group, an amino group, an alkoxy group, an alkenyloxy group, an alkylthio group, an alkenylthio group, an aryl group, an aryloxy group, an arylthio group, an acyl group, an acyloxy group, an acylamino group, a carbamoyl group, a sulfonamido group, a sulfamoyl group, an alkoxycarbonyl group, an aryloxycarbonyl group, an alkenyloxycabonyl group, a cycloalkyl group, a cycloalkenyl group and a heterocyclic ring.

Concrete exemplification of the compounds of general formula [XII] is disclosed in U.S. Pat. Nos. 3,928,041 and 3,632,345 as well as the synthesis thereof.

As the DIR compounds to be used in this invention, DIR hydroquinones and DIR substances which form colorless compounds, are more preferable for the objects of this invention than DIR couplers which form a colored dye by the reaction with an aromatic primary amine developing agent. Particularly, the compounds of general formulae [X], [XI] and [XII] are preferable, and further preferably the compounds of general formulae [X] and [XI] and the compounds of general formula [XII] wherein W represents halogen. Further, more preferably the compounds of general formula [X] and of the formula [XII] wherein W is halogen, and most preferably the compounds of general formula [X].

Typical DIR compounds used in this invention will be exemplified below, but those used in this invention should not be limited thereto.

| Exemplified Compounds: | |
|---|---|
| (D-1) | 1-hydroxy-4-(1-phenyl-5-tetrazolylthio)-2′-tetradecyloxy-2-naphthanilide |
| (D-2) | 1-hydroxy-4-(1-phenyl-5-tetrazolylthio)-N-[δ-(2,4-di-tert.-amylphenoxy)butyl]-2-naphthamide |
| (D-3) | 1-hydroxy-4-(2-benzthiazolylthio)-N-[δ-(2,4-di-tert.-amylphenoxy)butyl]-2-naphthamide |
| (D-4) | 5-methoxy-2-[α-(3-n-pentadecylphenoxy)butylamido)-4-(1-phenyl-5-tetrazolylthio)-phenol |
| (D-5) | 1-hydroxy-4-(2-nitrophenylthio)-N-[δ-(2,4-di-tert.-amylphenoxy)butyl]-2-naphthamide |
| (D-6) | 1-hydroxy-4-(1-phenyl-5-tetrazolylseleno)-2′-tetradecyloxy-2-naphthanilide |
| (D-7) | 2-(1-phenyl-5-tetrazolylthio)-5-n-dodecylthiohydroquinone |
| (D-8) | 2-n-octadecyl-5-(1-phenyl-5-tetrazolylthio)-hydroquinone |
| (D-9) | 1,4-bis-chloroacetoxy-2-(1-phenyl-5-tetrazolylthio)benzene |
| (D-10) | 2-(1-phenyl-5-tetrazolylthio)cyclopentanone |
| (D-11) | 1-(1-phenyl-5-tetrazolylthio)cyclohexanone |
| (D-12) | 2-(1-phenyl-5-tetrazolylthio)-indanone |
| (D-13) | 2,5-bis-(1-phenyl-5-tetrazolylthio)cyclopentanone |
| (D-14) | 2-(2-benzthiazolylthio)-4-(2,4-di-tert.-amylphenoxyacetamido)-1-indanone |
| (D-15) | 2-(1-phenyl-5-tetrazolylthio)-4-(2,4-di-tert.-amylphenoxyacetamido)-1-indanone |
| (D-16) | 2-(1-phenyl-5-tetrazolylthio)-6-(2,4-di-tert.-amylphenoxyacetamido)-1-indanone |
| (D-17) | 2-(1-phenyl-5-tetrazolylthio)-4-nitro-6-tert.-butyl-1-indanone |
| (D-18) | 2-(1-phenyl-5-tetrazolylthio)-4-octadecylsuccinimido-1-indanone |
| (D-19) | 2-(2-nitrophenylthio)-6-stearoyloxy-cyclohexanone |
| (D-20) | 2-(2-benzoxazolylthio)-5-dodecyloxy-cyclopentanone |
| (D-21) | 2-(1-phenyl-5-tetrazolylthio)-cyclopentanone-oxime |
| (D-22) | 2-(1-phenyl-5-tetrazolylthio)-1-indanone-phenylhydrazide |
| (D-23) | 2-(1-phenyl-5-tetrazolylthio)-6-(2,4-di-tert.-amylphenoxyacetamido)-1-indanone-oxime |
| (D-24) | 2-bromo-2-(1-phenyl-5-tetrazolylthio)-4-octadecylsuccinimido-1-indanone |
| (D-25) | 2-bromo-2-(1-phenyl-5-tetrazolylthio)-4-nitro-6-tert.-butyl-1-indanone-oxime |
| (D-26) | 2-bromo-2-(1-phenyl-5-tetrazolylthio)-4- |

-continued

| | Exemplified Compounds: |
|---|---|
| | nitro-6-tert.-butyl-1-indanone |
| (D-27) | 3-chloro-3-(1-phenyl-5-tetrazolylthio)-1-N-dodecyl-4-piperidone |
| (D-28) | 2-bromo-2-(2-nitrophenylthio)-6-stearoyloxy-cyclohexanone |
| (D-29) | 2-(1-benztriazolyl)-4-(2,4-di-tert.-amyl-phenoxyacetamido)-1-indanone |
| (D-30) | 3-(4-nitro-1-indazolyl)-1-N-dodecyl-4-piperidone |
| (D-31) | 2-(5-methyl-2-benztriazolyl)-5-decyl-cyclopentanone |
| (D-32) | 2-(methyl-1-benztriazolyl)-5-decyl-cyclo-pentanone-phenylhydrazide |
| (D-33) | 2-(1-phenyl-5-tetrazolylseleno)-4-octadecyl-succinimido-1-indanone |
| (D-34) | 2-bromo-2-(1-phenyl-5-tetrazolylseleno)-4-octadecylsuccinimido-1-indanone |
| (D-35) | 3-(1-phenyl-5-tetrazolylseleno-1-N-dodecyl-4-piperidone |
| (D-36) | 3-(1-phenyl-5-tetrazolylthio)-1-N-dodecyl-4-piperidone |
| (D-37) | 3-(1-phenyl-5-tetrazolylthio)oxyindole |
| (D-38) | 1,3-phenyl-4-(1-phenyl-5-tetrazolylthio)-hydantoin |
| (D-39) | 3-(2-benzthiazolylthio)-N-methyl-4-piperidone |
| (D-40) | ω-bromo-ω-(1-phenyl-5-tetrazolylthio)-4-lauroylamido-acetophenone |
| (D-41) | ω-(1-phenyl-5-tetrazolylthio)-4-lauroylamido-acetophenone |
| (D-42) | ω-chloro-ω-(1-phenyl-5-tetrazolylthio)-4-n-dodecylacetophenone |
| (D-43) | ω-chloro-ω-(2-benzoxazolylthio)-acetophenone |
| (D-44) | ω-acetoxy-ω-(1-phenyl-5-tetrazolylthio)-acetophenone |
| (D-45) | ω-phenoxy-ω-(1-phenyl-5-tetrazolylthio)-acetophenone |
| (D-46) | α-(1-phenyl-5-tetrazolylthio)-N-octadecyl-acetamide |
| (D-47) | ω-bromo-ω-(1-phenyl-5-tetrazolylseleno)-4-lauroylamidoacetophenone |
| (D-48) | α-(1-phenyl-5-tetrazolylseleno)-N-octadecyl-acetamide |

One of the characteristic features of the light-sensitive silver halide color photographic material according to this invention is in that at least one constructive layer unit which comprises i) the first light-sensitive silver halide layer, ii) the non-light-sensitive layer adjacent to said first light-sensitive silver halide layer and iii) the second light-sensitive silver halide layer, applied on the support in this order from the support, is contained.

The light-sensitive material according to this invention may or may not contain one or more layers additionally so far as the above-mentioned constructive layer unit is contained. A typical embodiment of this invention contains three light-sensitive layers, i.e. red-sensitive, green-sensitive and blue-sensitive light-sensitive layers on the support, which are different in sensitivity to light, respectively. In that case, for example, two different color-sensitivities are imparted to the first and second light-sensitive layers of the constructive layer unit and a light-sensitive layer which is sensitive to a further different color may be included. When a light-sensitive layer other than layers constituting the above constructive layer unit is contained, such light-sensitive layer may be applied, if necessary, on the side nearer to the support than the constructive layer unit, or on the outer side of the support. Further, such layers may be applied on one side and/or both sides in plurality. If necessary, a non-light-sensitive layer may be arranged between the constructive layer unit and another or other light-sensitive layers, or between other light-sensitive layers. In the present invention, the effect thereof can be achieved more readily when other light-sensitive layer is applied on the outside of the constructive layer unit to the support.

The first light-sensitive silver halide layer is a silver halide layer having the sensitivity to one kind of color. Consequently, so far as the sensitive regions are the same, the first light-sensitive layer may be constructed from two or more layers of silver halide emulsion layers. These light-sensitive layers can be used in the combination of different sensitivities.

The light-sensitive silver halide layer is preferably constructed by 1 to 3 emulsion layers having different sensitivities.

In this case, the cyan coupler and the DIR compound so far as these are contained in the same light-sensitive layer, may be added to the same emulsion layer or to the separate emulsion layers.

In order to include said 2 equivalent cyan coupler and DIR compound according to this invention into one or more emulsion layers which constitute the first light-sensitive silver halide layer, various known arts which have heretofore been used for photographic couplers can be applied.

For example, as disclosed in U.S. Pat. No. 2,322,027, the above coupler and DIR compound are dissolved in a high-boiling-point solvent and then included into an emulsion, or as disclosed in U.S. Pat. No. 2,801,170, the coupler and/or DIR compound and a high-boiling-point solvent are dispersed in fine particles separately and thereafter mixed to be included in an emulsion. In these methods by means of dispersion, a low-boiling-point organic solvent or a water-soluble organic solvent is preferably used. In that case, the DIR compound used in this invention may be mixed with a 2-equivalent cyan coupler and/or, if necessary, another or other cyan couplers, dispersed and included in the same emulsion as the same particle. Alternatively, it may be dispersed separately from a 2 equivalent cyan coupler and then included in the same or different emulsion as separate particles. Further, when a low-boiling-point or water-soluble organic solvent is used, the low-boiling-point or water-soluble organic solvent can be removed from the dispersion solution by means of the process as disclosed in U.S. Pat. No. 2,801,171 or British Pat. No. 1,307,686. Alternatively, when a cyan coupler containing a water-soluble group and a DIR compound are used, they can be added to the emulsion according to a Fischer's process i.e. by dissolving in an alkali solution. Furthermore, it is possible to add to the same layer at least one of the cyan coupler and DIR compound according to the dispersion method and the other according to the Fischer's process.

Referring to a method of addition of an oil-soluble substance among the 2 equivalent cyan coupler and the DIR compound of the present invention, it is preferable to add the coupler, etc. to a silver halide emulsion according to the method described, for example, in U.S. Pat. Nos. 2,801,171; 2,272,191 and 2,304,940 by dissolving and dispersing the coupler, etc. in a high-boiling-point solvent, if necessary, combined with a low-boiling-point solvent. If necessary, another cyan coupler, a hydroquinone derivative, a UV-absorber, an antioxidant, or the like can be added without any adverse effect. Further, in such case, the coupler and the DIR compound of this invention can be used without any adverse effect even in the form of a mixture of two or more of them, respectively. More particularly, the method of addition of the coupler, etc. of this invention comprises dissolving one or more couplers and the other ingredients of this invention, if necessary, together with other cyan couplers, a hydroquinone derivative, a UV-absorber, an antioxidant, etc. in a high-boiling-point solvent such as organic acid amides, carbamates, esters, ketones, urea derivatives, in particular di-n-butylphthalate, tricresyl phosphate, triphenyl phosphate, di-isooctyl azelate, di-n-butyl sebacate, tri-n-hexyl phosphate, N,N-diethyl-caprylamide butyl, N,N-diethyl-laurylamide, n-pentadecyl phenyl ether, di-octyl phthalate, n-nonyl phenol, 3-pentadecyl phenyl ethyl ether, 2,5-di-sec.-amylphenylbutyl ether, monophenyl-di-O-chlorophenyl phosphate or fluorinated paraffin, if necessary, combined with a low-boiling-point solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane tetrahydrofuran, methyl alcohol, ethyl alcohol, acetnitrile, dimethylformamide, dimethylsulfoxide, dioxane, methyl ethyl ketone, etc. (these high-boiling-point solvent and low-boiling-point solvent may be used alone or in combination), mixing with an aqueous solution which contains a hydrophilic binder such as gelatin containing an anionic surface active agent, e.g. alkylbenzenesulfonic acid and alkylnaphthalenesulfonic acid and/or a nonionic surface active agent, e.g. a sorbitan sesquioleic acid ester and a sorbitan monolauric acid ester, emulsifying and dispersing the mixture by means of a high speed rotary mixer, a colloid mill or a supersonic dispersion apparatus and then adding the dispersion product to a silver halide emulsion.

Among the couplers and the DIR compounds of this invention, compounds which are liquid at a normal temperature or compounds which show a low melting point can be used without any adverse effect as solvents for said oil-soluble compounds in place of a part or all of the above-mentioned high-boiling-point solvents.

In one of the emulsion layers of the first light-sensitive layer constituting the layer unit of this invention, further a cyan coupler and/or a colored cyan coupler which is not included within the scope of this invention may be contained. Such cyan coupler and/or a colored cyan coupler may be contained either in the same layer (in which the cyan coupler and/or the DIR compound of this invention is contained), or in a different layer. Further, these cyan couplers may be present either in the same oil drop together with the cyan coupler and/or the DIR compound of this invention, or as a different oil drop. Furthermore, some of such cyan couplers may be included by the above-mentioned Fischer's type dispersion method. The same method for dispersion and addition as that for the present coupler may be applied to such couplers.

As cyan couplers which may additionally be used in this invention but are not included within the scope of this invention, there are used in general phenol or naphthol derivatives. Examples of such cyan couplers are given in U.S. Pat. Nos. 2,423,730; 2,474,293; 2,801,171; 2,895,826; 3,476,563; 3,737,316; 3,758,308 and 3,839,044, Japanese Patent L-O-P Publication No. 50-25228; No. 50-112038; No. 50-117422 and No. 50-130441.

Such cyan couplers that are outside the scope of this invention but conveniently used in this invention will be exemplified below.

| | |
|---|---|
| C'-1 | 1-hydroxy-N-[δ-(2,4-di-tert.-amylphenoxy)butyl]-2-naphthamide |
| C'-2 | 1-hydroxy-N-[δ-(2,4-di-tert.-amylphenoxy)butyl]-2-naphthamide |
| C'-3 | 2,4-dichloro-3-methyl-6-(2,4-di-tert.-amylphenoxyacetamido)phenol |
| C'-4 | 2,4-dichloro-3-methyl-6-[α-(2,4-di-tert.-amylphenoxy)butylamido]phenol |
| C'-5 | 2-perfluorobutylamido-5-[α-(2,4-di-tert.-amylphenoxy)hexanamido]phenol |
| C'-6 | 1-hydroxy-4-(octadecylsuccinimido)-N-ethyl-3',5'-dicarboxy-2-naphthamide |
| C'-7 | 1-hydroxy-4-[3-(1,2-dicarboxyethyl)succinimido)-N-ethyl-2-naphthamide |
| C'-8 | 1-hydroxy-4-maleinimido-N-[δ-(2,4-di-tert.-amylphenoxy)butyl]-2-naphthamide |
| C'-9 | 2-(α,α,β,β-tetrafluoropropionamido)-5-[α-(2,4-di-tert.-amylphenoxy)butylamido)phenol |
| C'-10 | 1-hydroxy-N-dodecyl-2-naphthamide |

As the colored cyan couplers which may be used in this invention, these are used in general phenol or naphthol derivatives and examples of such couplers are mentioned, for example, in U.S. Pat. Nos. 2,521,908 and 3,034,892, British Patent No. 1,255,111, Japanese Patent L-O-P Publication No. 48-22028; No. 50-123341 and No. 50-10135, and U.S. Pat. No. 3,476,563.

Examples of colored cyan couplers conveniently used in this invention are as follows:

| | |
|---|---|
| CC-1 | 1-hydroxy-4-(2-acetylphenylazo)-N-[δ-(2,4-di-tert.-amylphenoxy)butyl]-2-naphthamide |
| CC-2 | 1-hydroxy-4-[2-(β-phenylpropionyl)phenylazo]-N-[δ-(2,4-di-tert.amylphenoxy)butyl]-2-naphthamide |
| CC-3 | 1-hydroxy-4-phenylazo-4'-(4-tert.-butylphenoxy)-2-naphthanilide |
| CC-4 | 1-hydroxy-4-[4-(1-hydroxy-8-acetamido-3,6-disulfo-2-naphthylazo(phenoxy]-N-[δ-(2,4-di-tert.-amylphenoxy)butyl]-2-naphthamide disodium salt |
| CC-5 | 1-hydroxy-4-[4-(2-hydroxy-3,6-disulfo-1-naphthylazo)phenylcarbamoyloxy]-N-[δ-(2,4-di-tert.-amylphenoxy)butyl-2-naphthamide disodium salt |
| CC-6 | 1-hydroxy-4-(2-ethoxycarbonylphenylazo)-N-[δ-(2,4-di-tert.-amylphenoxy)butyl]-2-naphthamide |

As the UV-absorber used in the first light-sensitive layer together with the present coupler, there are included thiazolidone, benzotriazole, acrylonitrile and benzophenone series compounds as described, for example, in U.S. Pat. Nos. 2,739,888; 3,004,896; 3,253,921; 3,533,794; 3,692,525; 3,705,805; 3,738,837; 3,754,919; 3,052,636 and 3,707,375 and British Patent 1,321,355. Use of the above-mentioned compounds is convenient for preventing color fading due to short wave-length actinic rays and, in particular, use of Tinuvin PS, Tinuvin 320, Tinuvin 327 or Tinvin 328 (products of Ciba-Geigy) alone or in combination is convenient.

As the hydroquinone derivative used together with the present coupler, an precursor thereof is also included. The term precursor referred to herein means such compound as releasing a hydroquinone derivative on hydrolysis.

Examples of nucleus-substituted hydroquinones used in this invention are given, for example, in U.S. Pat. Nos. 2,336,327; 2,360,290; 2,384,658; 2,403,721; 2,418,613; 2,675,314; 2,701,197; 2,704,713; 2,710,801; 2,722,550; 2,728,659; 2,732,300; 2,735,765; 2,816,028; 3,062,884 and 3,236,896, British Patent 557,750 and 557,802, DOS (Deutsche Offenlegungs Schrift)

2,149,789, Japanese Patent Publication No. 44-54116, Japanese Patent L-O-P Publication No. 46-2128 and Journal of Organic Chemistry, 22, 772–774.

Among the nucleus-substituted hydroquinone derivatives, those in which the total carbon atom number (contained in substituents on the nucleus) of 8 or more are less diffusible and consequently suitable for being selectively contained in the particular hydrophilic layer of the light-sensitive material.

Among the hydroquinone derivatives used in this invention, those in which a substituent on the nucleus is substituted or unsubstituted alkyl are particularly useful.

These hydroquinone derivatives may be used alone or in combination with two or more of them. Preferable amount to be added is generally 0.01–10 mols per mol of the coupler in the light-sensitive coupler-containing color material, and particularly 0.1–3 mols are preferable.

The amount of the 2-equivalent cyan coupler of this invention to be contained in the first light-sensitive silver halide layer is in general within the range of about 0.005–5 mols, more preferably 0.01–0.4 mol per mol of silver halide in the emulsion in which it is to be contained. Further, when a coupler which is outside the scope of this invention is to be included in the same layer as the present cyan coupler, it is preferable to include the present cyan coupler usually in an amount within range of 0.01–0.1 mol per mole of silver halide. The coupler which is outside the scope of this invention can be contained if necessary in an amount up to 100 times (more preferably 10 times) of that of the present coupler in molar ratio, without causing any damage to the effect of this invention.

In the light-sensitive silver halide color photographic material according to this invention, when a DIR substance as represented by general formula (X)–(XI) is to be included in the first light-sensitive silver halide layer, an amount of said DIR substance is, in general, preferably within the range of 0.005–0.5 mole (more preferably 0.01–0.1 mol) per mol of silver halide in the emulsion layer in which said substance to be included.

The DIR coupler as represented by general formula (VI), (VII) or (VIII) is used generally in an amount of 0.01–0.5 times mol of the silver halide in the emulsion layer in which said DIR coupler is to be included. When a DIR hydroquinone as represented by general formula [IX] is used as the present DIR compound, said DIR hydroquinone may be used either in combination with the DIR coupler or alone, in an amount of less than 60 mol%, preferably less than 20 mol% of the total amount of the cyan coupler contained in the first light-sensitive layer.

Further, when a developing agent which releases a development inhibiting compound as described in U.S. Pat. No. 3,379,529 is to be included, such developing agent is generally used in an amount of about 0.01–4 mols per mol of silver halide in the emulsion layer in which said developing agent is to be included, more preferably 0.1–2.0 mols.

In the present constructive layer unit, the second light-sensitive layer which is applied on the first light-sensitive layer through the non-light-sensitive layer is also constituted by one or more silver halide emulsion layers so far as these layers have the same color-sensitivity regions.

In the present invention, the second light-sensitive silver halide layer is preferably a silver halide emulsion layer having a different color-sensitivity from the first silver halide emulsion layer and more preferably a red-sensitive light-sensitive layer.

The second light-sensitive layer may be constructed by two or more emulsion layers and these light-sensitive layers can be used in the combination of different sensitivities. Further, as the couplers contained in each of the silver halide emulsion layers, any 2-equivalent coupler or 4-equivalent coupler may be used. For example, a coupler which forms the same color as the 2-equivalent coupler and/or the 4-equivalent coupler but is a different type from the 2-equivalent coupler or the 4-equivalent coupler may be included in each of the layers. Such coupler may be used in combination with the 2-equivalent type coupler or 4-equivalent type coupler and as the 2-equivalent type coupler, so-called colored coupler (for example, a coupler wherein a split-off group having azo group is attached as the binding group at the active point of coupler) or so-called DIR coupler (that is such type of coupler as releasing a coloring inhibiting agent during the development, for example, a coupler wherein a split-off group having this group is attached as the binding group at the active point of the coupler) can be used.

Further, in the present invention, the second light-sensitive silver halide layer may not contain any coupler.

Furthermore, in the first light-sensitive silver halide layer, the second light-sensitive silver halide layer and other silver halide emulsion layers, there may be included ordinary photographic additives such as a sensitizing dye, chemical sensitizer, stabilizer, etc., as referred to hereinafter in detail. It is preferable to include in the second light-sensitive layer the above-mentioned DIR compound.

As a magenta coupler usable in this invention, there are included pyrazolone-, pyrazolotriazole-, pyrazolinobenzimidazole- and indazolone-series compounds. As the pyrazolone magenta coupler, the compounds as described in U.S. Pat. Nos. 2,600,788; 3,062,653; 3,127,269; 3,311,476; 3,419,391; 3,519,429; 3,558,318; 3,684,514 and 3,888,680, Japanese Patent L-O-P Publication No. 49-29639; No. 49-111631; No. 49-129538 and No. 50-13041, Japanese Patent Application No. 50-24690; No. 50-134470 and 50-156327 can be used conveniently in this invention. As the pyrazolotriazole magenta coupler, the compounds described in U.S. Pat. Nos. 1,247,493 and Belgian Patent No. 792,525; as the pyrazolinobenzimidazole magenta coupler, the compounds described in U.S. Pat. No. 3,061,432, German Patent No. 2,156,111 and Japanese Patent Publication No. 46-60479; and further as the indazolone magenta coupler, the compound described in Belgian Patent 769,116 can preferably used in this invention.

Magenta couplers which are particularly useful in this invention will be given below.

---

M-1 1-(2,4,6-trichlorophenyl)-3-[3-(2,4-di-tert.-amylphenoxyacetanide)benzanide]-5-pyrazolone M-2 1-(2,4,6-trichlorophenyl)-3-(3-dodecylsuccinimidobenzamido)-5-pyrazolone M-3 4,4'-methylenebis{1-(2,4,6-trichlorophenyl)-3-[3-(2,4-di-tert.-amylphenoxyacetamido)benzamido]-5-pyrazolone}

M-4 1-(2,4,6-trichlorophenyl)-3-(2-chloro-5-octadecylsuccinimidoanilino)-5-pyrazolone M-5 1-(2-chloro-4,6-dimethylphenyl)-3-{3-[α-(3-pentadecylphenoxy)butylamido]benzamido}-5-

-continued

| | |
|---|---|
| | pyrazolone |
| M-6 | 1-(2,4,6-trichlorophenyl)-3-(2-chloro-5-octadecylcarbamoylanilino)-5-pyrazolone |
| M-7 | 3-ethoxy-1-{4-[α-(3-pentadecylphenoxy)butylamido]-phenyl}-5-pyrazolone |
| M-8 | 1-(2,4,6-trichlorophenyl)-3-(2-chloro-5-tetradecanamidoanilino)-5-pyrazolone |
| M-9 | 1-(2,4,6-trichlorophenyl)-3-{2-chloro-5-[α-(3-tert.-butyl-4-hydroxyphenoxy)tetradecanamido]-anilino}-5-pyrazolone |
| M-10 | 1-(2,4,6-trichlorophenyl)-3-[3-(2,4-di-tert.-amylphenoxyacetamido)benzamido]-4-acetoxy-5-pyrazolone |
| M-11 | 1-(2,4,6-trichlorophenyl)-3-[3-(2,4-di-tert.-amylphenoxyacetamido)benzamido]-4-ethoxy-carbonyloxy-5-pyrazolone |
| M-12 | 1-(2,4,6-trichlorophenyl)-3-[3-(2,4-di-tert.-amylphenoxyacetamido)benzamido]-4-(4-chloro-cinnamoyloxy)-5-pyrazolone |
| M-13 | 4,4'-benzylidenebis[1-(2,4,6-trichlorophenyl)-3-{2-chloro-5-[γ-(2,4-di-tert.-amylphenoxy)butyl-amido]anilino}-5-pyrazolone |
| M-14 | 4,4'-benzylidenebis[1-(2,3,4,5,6-pentachloro-phenyl)-3-{2-chloro-5-[γ-(2,4-di-tert.-amyl-phenoxy)butylamido]anilino}-5-pyrazolone] |
| M-15 | 4,4'-(2-chloro)benzylidenebis[1-(2,4,6-trichloro-phenyl)-3-(2-chloro-5-dodecylsuccinimidoanilino)-5-pyrazolone] |
| M-16 | 4,4'-methylenebis[1-(2,4,6-trichlorophenyl)-3-{3-[α-(2,4-di-tert.-amylphenoxy)butylamido]-benzamido}-5-pyrazolone] |

As the colored magenta couplers, such compounds as anylazo-substituted at the coupling position of colorless magenta couplers are generally used and compounds as disclosed in U.S. Pat. Nos. 2,801,171; 2,983,608; 3,005,712 and 3,684,514, British Patent No. 937,621, Japanese Patent L-O-P Publication No. 49-123625 and No. 49-31448 are included. Further, such type of a colored magenta coupler as disclosed in U.S. Pat. No. 3,419,391, by use of which the dye obtained moves out into the treatment bath during the reaction with the oxidation product of a developing agent can be used. Concrete exemplification of such couplers will be given below.

| | |
|---|---|
| CM-1 | 1-(2,4,6-trichlorophenyl)-4-(4-methoxyphenylazo-3-[3-(2,4-di-tert.-amylphenoxyacetamido)benz-amido]-5-pyrazolone |
| CM-2 | 1-(2,4,6-trichlorophenyl)-4-(1-naphthylazo)-3-(2-chloro-5-octadecenylsuccinimidoanilino)-5-pyrazolone |
| CM-3 | 1-(2,4,6-trichlorophenyl)-4-(4-hydroxy-3-methylphenylazo)-3-(2-chloro-5-tetradecan-amidoanilino)-5-pyrazolone |
| CM-4 | 1-(2,4,6-trichlorophenyl)-4-(4-hydroxy-3-methylphenylazo)-3-(2-chloro-5-octadecenyl-succinimidoanilino)-5-pyrazolone |
| CM-5 | 1-(2,4,6-trichlorophenyl)-3-{2-chloro-5-[α-(4-hydroxy-3-tert.-butylphenoxy)tetradecanamido]-anilino}-4-(1-naphthylazo)-5-pyrazolone |
| CM-6 | 1-(2,4,6-trichlorophenyl)-3-{2-chloro-5-[α-(2,4-di-tert.-amylphenoxy)butylamido]anilino}-4-(4-methoxyphenylazo)-5-pyrazolone |
| CM-7 | 1-(2,4,6-trichlorophenyl)-3-{2-chloro-5-[γ-(2,4-di-tert.-amylphenoxy)butylamido]anilino}-4-(4-hydroxyphenylazo)-5-pyrazolone |
| CM-8 | 1-(2,3,4,5,6-pentachlorophenyl)-3-{2-chloro-5-[γ-(2,4-di-tert.-amylphenoxy)butylamido]-anilino}-4-(4-hydroxyphenylazo)-5-pyrazolone |
| CM-9 | 1-phenyl-3-[2-chloro-4-{3-[α-(3-pentadecyl-phenoxy)acetamido]benzamido}anilino]-4-[4-(4-sulfophenylazo)phenoxy]-5-pyrazolone |

The non-light-sensitive layer used in this invention, which contains substantially non-light-sensitive silver halide particles does not form any image by the development. It adsorbs an inhibiting substance such as halogen released during development from image-forming silver halide emulsion layer. Further, said layer has the function to effectively adsorb the development inhibiting compound released during the development by the DIR compound. Said layer is particularly a non-light-sensitive hydrophilic colloid layer having an function to appropriately control the diffusion of the development inhibiting compound (for example, a halogen ion, and a development inhibiting type compound). The non-light-sensitive layer comprises one or more kinds of hydrophilic colloids and in at least one of said hydrophilic colloid layers, substantially non-light-sensitive silver halide particles are dispersed.

As the non-light-sensitive silver halide, any silver halide can be used so far as it is substantially non-light-sensitive, or is not substantially developed in the developing solution. Further, it is preferably not substantially developed nor dissolved in the developing solution. In the present invention, said silver halide grains which are substantially non-light-sensitive preferably have the average grain size of less than about 1μ (more preferably less than 0.3μ) and with regard to the distribution of such grains, wide or narrow distribution is acceptable, but narrow distribution is more preferable.

Silver halide particles used as the substantially non-light-sensitive silver halide particles may be any of silver chloride, silver bromide, silver iodide, silver bromoiodide, silver chlorobromide, silver chloroiodobromide, etc. These silver halides may be used alone or in combination of two or more of them. As the non-light-sensitive silver halide particles, silver halide containing silver bromide is preferable from the viewpoint of solubility and in particular, iodobromide containing less than 10 mol% of silver iodide is preferable. The above-mentioned silver halide particles may be sensitized by a metal ion such as a rhodan ion, a cyano ion, a thiocyanate ion, a gold ion, an iridium ion, etc., or may be physically ripened or etched by means of a solvent silver halide. These silver halide particles may be prepared by various processes for the preparation such as a neutral method, a half-ammonia method and an ammonia method and molded in various type of molds such as those for simultaneous mixing method, conversion method and the like. The silver halide of the non-light-sensitive layer is generally coated in an amount of 50–1 mg $Ag/m^2$, preferably 10–1 mg $Ag/m^2$. In the non-light-sensitive layer, there may be used at the same time colloidal silica, polymethylmethacrylate as a mat agent, a high-boiling point solvent (e.g. tricresyl phosphate, dioctyl phthalate), a UV-absorber, an antioxidant, a hydroquinone derivative as an oleophilic ingredient, a surface active agent as coating aid, gelatin-hardend milk, etc.

As the binder for the non-light-sensitive, gelatin is generally used, but in place of a part or whole of gelatin, there may be used colloidal albumin, agar, gum arabic, alginic acid, cellulose derivatives such as hydrolysed cellulose acetate, carboxymethyl cellulose, hydroxyethyl cellulose, etc., as well as synthetic binders, for example, polyvinyl alcohol, partially saponified polyvinyl acetate, polyacrylamide, poly-N,N-dimethylacrylamide, poly-N-vinylpyrrolidone, water-soluble polymers as described in U.S. Pat. Nos. 3,847,620; 3,655,389; 3,341,332; 3,615,424 and 3,860,428, gelatin derivatives, for example, phenylcarbamylated gelatin, acylated gelatin, phthalated gelatin as described in U.S. Pat. Nos. 2,614,928 and 2,525,753, and a graft-copolymerization product obtained from a monomer having polymerizable ethylene group such as acrylic acid (ester), methacrylic acid (ester) and acylonitrile as described in U.S. Pat. Nos. 2,548,520 and 2,831,767 and gelatin.

In addition to the above-mentioned constructive layer unit, the light-sensitive material of this invention preferably comprises one or more other light-sensitive layers. One of the preferable embodiment of this invention comprises inclusion of a third light-sensitive layer on the second emulsion layer, said third light-sensitive layer being blue-sensitive. Between this additional light-sensitive layer and the second emulsion layer, a further non-light-sensitive layer may be arranged and to this non-light-sensitive layer, the yellow filter function may be imparted by means of known art. Further, as another preferable embodiment, the constructive layer unit of this invention comprises, in addition to the above-mentioned blue-sensitive light-sensitive layer, another constructive layer unit through a non-light-sensitive layer blow the former unit. For example, such light-sensitive material is included, in which are applied, in sequence from the support side, a first red-sensitive emulsion layer, a non-light-sensitive layer, a first green-sensitive emulsion layer, a non-light-sensitive layer, a second red-sensitive emulsion layer, a non-light-sensitive layer, a second green-sensitive emulsion layer, a non-light-sensitive layer and a blue-sensitive light-sensitive layer.

The blue-sensitive emulsion contains a yellow couplers.

As the yellow coupler, an open-chain ketomethylene compounds have heretofore been used and further widely used benzoylacetanilide type yellow coupler and pivaloylacetanilide type yellow coupler can be used. Further, a 2-equivalent type yellow coupler in which the carbon atom at the coupling portion is substituted with a substituent which can be split-off in the coupling reaction is also conveniently used. Examples of such yellow couplers are given in U.S. Pat. Nos. 2,875,057; 3,265,506; 3,664,841; 3,408,194; 3,447,928; 3,277,155 and 3,415,652, Japanese Patent Publication No. 49-13576, Japanese Patent L-O-P Publication No. 48-29432; No. 48-66834; No. 49-10736; No. 49-122335; No. 50-28834 and No. 50-132926.

Concrete examples of yellow couplers particularly effective in the present invention will be given below.

| | |
|---|---|
| Y-1 | α-(4-carboxyphenoxy)-α-pivalyl-2-chloro-5-[γ-(2,4-di-tert.-amylphenoxy)butylamido]-acetanilide |
| Y-2 | α-ivalyl-2-chloro-5-[γ-(2,4-di-tert.-amylphenoxy)butylamido]acetanilide |
| Y-3 | α-benzoyl-2-chloro-5-[α-(dodecyloxycarbonyl)-ethoxycarbonyl]acetanilide |
| Y-4 | α-(4-carboxyphenoxy)-α-pivalyl-2-chloro-5-[α-(3-pentadecylphenoxy)butylamido]acetanilide |
| Y-5 | α-(1-benzyl-2,4-dioxo-3-imidazolidinyl)-α-pivalyl-2-chloro-5-[γ-(2,4-di-tert.-amylphenoxy)-butylamido]acetanilide |
| Y-6 | α-[4-(1-benzyl-2-phenyl-3,5-dioxo-1,2,4-triazolidinyl)]-α-pivalyl-2-chloro-5-[γ-(2,4-di-tert.-amylphenoxy)butylamido]acetanilide |
| Y-7 | α-acetoxy-α-{3-[α-(2,4-di-tert.-amylphenoxy)-butylamido]benzoyl}-2-methoxyacetanilide |
| Y-8 | α-{3-[α-(2,4-di-tert.-amylphenoxy)butylamido]-benzoyl}-2-methoxyacetanilide |
| Y-9 | α-[4-(4-benzyloxyphenylsulfonyl)phenoxy]-α-pivalyl-2-chloro-5-[γ-(2,4-di-tert.-amylphenoxy)-butylamido]acetanilide |
| Y-10 | α-pivalyl-α-(4,5-dichloro-3(2H)-pyridaz-2-yl)-2-chloro-5-[(hexadecyloxycarbonyl)methoxy-carbonyl]acetanilide |
| Y-11 | α-pivalyl-α-[4-(p-chlorophenyl)-5-oxo-$\Delta^2$-tetra-zolin-1-yl]-2-chloro-5-[α-(dodecyloxycarbonyl)-ethoxycarbonyl]acetanilide |
| Y-12 | α-(2,4-dioxo-5,5-dimethyloxazolidin-3-yl)-α-pivalyl-2-chloro-5-[α-(2,4-di-tert.-amylphenoxy)-butylamido]acetanilide |
| Y-13 | α-pivalyl-α-[4-(1-methyl-2-phenyl-3,5-dioxo-1,2,4-triazolidinyl)]-2-chloro-5-[γ-(2,4-di-tert.-amylphenoxy)butylamido]acetanilide |
| Y-14 | α-pivalyl-α-[4-(p-ethylphenyl)-5-oxo-$\Delta^2$-tetrazolin-1-yl]-2-chloro-5-[γ-(2,4-di-tert.-amylphenoxy)butylamido)acetanilide |

The light-sensitive silver halide photographic material according to this invention will be explained hereinafter in further detailed manner.

As the silver halide used in the silver halide emulsion layer of the light-sensitive silver halide photographic material according to this invention, any silver halide as used in an ordinary silver halide photographic emulsion such as silver chloride, silver bromide, silver iodide, silver chlorobromide, silver iodobromide and silver chloroiodobromide is included.

Silver halide particles may be crude particles or fine particles and the distribution of particle size may be wide or narrow. Further, the crystal system of these silver halide particles may be normal or twin and any ratio between (100) surface and (111) surface may be accepted. Furthermore, the crystal construction of silver halide particles may be homogeneous both in the inside and the outside, or may be bormed by layers distinguished in the inside and the outside. The silver halide may be either type that forms a latent image principally on the surface or type that forms the latent image in the inside of the particle. The silver halide particles as mentioned above can be prepared by a known method ordinarily used in the art.

Any of the silver halide prepared according to the method described, for example, in C. E. K. Mees, T. H. James and MacMillan's The Theory of The Photographic Process, third edition, 1966, the second chapter, pages 31–43, Japanese Patent Publications No. 46-7772; No. 46-18103 and No. 51-1417, U.S. Pat. No. 2,592,250 or British Patent 635,841 can be used in this invention conveniently.

Silver halide emulsion used in this invention is preferably freed from soluble salts, but such silver halide emulsion from which soluble salts have not yet been removed can also be used. Alternatively, two or more silver halide emulsions which have been prefered separately can be used in combination.

As the binder of the silver halide emulsion layer of the light-sensitive material of this invention, there are included gelatin, colloidal albumin, agan, gum arabic, alginic acid, cellulose derivatives such as hydrolysed cellulose acetate, carboxymethyl cellulose, hydroxyethyl cellulose, methyl cellulose as well as synthetic binders, for example, polyvinyl alcohol, partially saponified polyvinyl acetate, polyacrylamide, poly-N,N-dimethylacrylamide, poly-N-vinylpyrrolidone, a water-soluble polymer as described in U.S. Pat. Nos. 3,847,620; 3,655,389; 3,341,332; 3,615,424 and 3,860,428, gelatin derivatives, for example, phenylcarbamylated gelatin acylated gelatin, phthalated gelatin as described in U.S. Pat. Nos. 2,614,928 and 2,525,753 and a graft-copolymerization product obtained by graft-copolymerizing a monomer having polymerizable ethylene group such as acrylic acid (ester), methacrylic acid (ester) and acrylonitrile to gelatin. These binders can be used if necessary as compatible mixture comprising two or more said binders.

The silver halide photographic emulsion wherein the afore-mentioned silver halide particles are dispersed in the solution of the binder can be sensitized by a chemical sensitizer. The chemical sensitizer which can conveniently be used in the present invention is broadly classified into four types of a noble metal sensitizer, sulfur sensitizer, selenium sensitizer and reductive sensitizer.

The noble metal sensitizer includes the gold compounds as described in U.S. Pat. Nos. 2,399,083; 2,540,085; 2,597,856; 2,597,915 and 2,642,361 and ruthenium, rhodium, palladium, iridium and platinum compounds as described in U.S. Pat. Nos. 2,448,060; 2,540,086; 2,566,245; 2,566,263; 2,598,079 and 3,297,446. Particularly preferable compounds include chloroauric acid, potassium chloroaurite, potassium aurithiocyanate, potassium chloroaurate, 2-aurosulfobenzothiazole methylchloride, ammonium, chloropalladate, potassium chloro-platinate, sodium chloro-palladite and sodium chloro-iridate. When the gold compound is used, further ammonium thiocyanate and sodium thiocyanate can be used together.

The sulfur sensitizer includes, in addition to active gelatin, the sulfur compounds as described in U.S. Pat. Nos. 1,574,944; 1,623,499; 2,278,947; 2,410,689; 3,189,458 and 3,297,447 and particularly preferable compounds include sodium thiosulfate, ammonium thiosulfate, thiourea, thioacetamide, allylisothiourea and N-allylrhodanine.

Selenium sensitizer includes active and inactive selenium compounds as described in U.S. Pat. Nos. 3,297,446; 3,442,653 and 3,297,447, and particularly preferable compounds include colloid selenium selenoacetphenone, selenoacetamide, selenourea, N,N-dimethylselenourea and triphenylphosphene selenide.

The reductive sensitizer includes a monovalent tim salt as described in U.S. Pat. No. 2,487,850, polyamine as described in U.S. Pat. Nos. 2,518,698 and 2,521,925, bisalkylaminosulfide as described in U.S. Pat. No. 2,521,926, a silan compound as described in U.S. Pat. No. 2,694,637, icyno aminomethanesulfinic acid, hydradinium salt as described in U.S. Pat. No. 3,201,254 and hydrazine derivatives as described in U.S. Pat. Nos. 2,419,974 and 2,419,975.

Further, the photographic emulsion may be subjected, if necessary, to spectral sensitization or supersensitization, using cyanine dyes such as cyanine, merocyanine and carbocyanine alone or in combination or using such cyanine dye in combination with a styryl dye. These color sensitization methods have been known for long time and are disclosed in U.S. Pat. Nos. 2,688,545; 2,912,329; 3,397,060; 3,615,635 and 3,628,964, British Patents 1,195,302; 1,242,588 and 1,293,862, German Patents (OLS) Nos. 2,030,326 and 2,121,780 and Japanese Patent Publications No. 43-4936 and No. 44-14030. The sensitization method can optionally be selected based on the wavelength part, speed to be sensitized as well as the object and use of the light-sensitive material.

In the present invention, a stabilizer can be included in the silver halide emulsion layer. Stabilizers useful in the present invention include the following compounds:

As one of said compounds, nitrogen-containing heterocyclic compounds, particularly tetrazaindene compounds, for example, those described in U.S. Pat. Nos. 2,444,605; 2,444,606; 2,444,607; 2,444,608; 2,444,609; 2,716,062; 2,835,581; 2,852,372; 2,933,388 and 3,202,512 are effective. Among the above compounds, particularly preferable compounds are 4-hydroxy-6-methyl-1,3,3a,7-tetrazaindene as described in U.S. Pat. No. 2,716,062 and

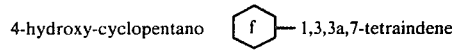

as described in U.S. Pat. No. 2,444,607.

Further, the pentazaindene compounds described in U.S. Pat. Nos. 2,713,541 and 2,743,181, 4-oxo-6-thiono-4,5,6,7-tetrahydro-1-thia-3,5,7-triazaindene as described in U.S. Pat. No. 2,772,164, 2-substituted benzoimidazole, benzotiazole as described in U.S. Pat. No. 3,137,578, substituted 1,2,3-triazole as described in U.S. Pat. No. 3,157,509, urazol as described in U.S. Pat. No. 3,287,135, pyrazole as described in German Pat. No. 2,058,626 and U.S. Pat. No. 3,106,467, a tetrazole compound and polyvinyl pyrrolidone as described in German Patent 1,189,380 can also be used in this invention. Particularly, polyvinylpyrrolidone is useful in this invention.

Furthermore, a quaternary ammonium salt is also useful in the present invention. For example, triazolium compounds described in U.S. Pat. Nos. 2,131,038; 2,673,149 and 3,342,596 and a pyrylium compound described in U.S. Pat. No. 3,148,067 are useful. Among the above compounds, particularly, the benzothiazolium compound described in U.S. Pat. No. 3,342,596 is effective.

A mercapto compound is also similarly useful.

For example, 5-phenyl-1-mercaptotetrazole and 2-mercapto-benzothiazole as described in U.S. Pat. No. 2,403,927, 2-mercaptothiazole, mercaptobenzimidazole as described in U.S. Pat. No. 2,824,001, mercaptooxadiazole as described in U.S. Pat. No. 2,843,491, mercaptothiadiazole as described in U.S. Pat. No. 1,758,576, thiosugar as described in Japanese Patent Publication No. 43-4417, 4-thiouracil as described in U.S. Pat. Nos. 3,622,340; 3,759,908 and 3,837,859 are effective. Among the above compounds, those particularly useful are 5-phenyl-1-mercaptotetrazole, 2-mercaptobenzothiazole as described in U.S. Pat. No. 2,403,921.

A polyhydroxybenzene compound is also similarly useful.

For example, the 1,2-dihydroxybenzene compound as described in U.S. Pat. No. 3,236,652, an ester of gallic acid (for example, isoamyl gallate, dodecyl gallate and propyl gallate) as described in Japanese Patent Publication No. 43-4133 and 2-alkyl-hydroquinone as described in German Patent 2,149,789 are effective. Among the above, a gallic acid ester as described in Japanese Patent Publication No. 43-4133 is, in particular, effective.

Further, an aliphatic carboxylic acid as described in U.S. Pat. No. 3,128,187 and a short wavelength cyanine dye as described in Japanese Patent Application No. 50-38426 are also useful.

A thion compound, for example, the thiazolin-2-thion compound as described in U.S. Pat. Nos. 3,536,487 and 3,598,598 is also useful.

Further, an inorganic salt, for example, the mercury salt as described in U.S. Pat. Nos. 2,728,664 and 2,728,665 and a Zn salt and a Cd salt as described in U.S. Pat. No. 2,839,405 are also similarly useful.

In the present invention, useful stabilizers which are included in the silver halide emulsion layer are as defined above, but more preferable stabilization effect can be achieved by using such stabilizers in combination to one another. Such effect can be achieved by combination use of phenyl mercaptotetrazole and polyvinylpyrrolidone as described in U.S. Pat. No. 3,804,633, combination used of phenylmercaptotetrazoles as described in German Patent No. 2,118,411, combination used of phenylmercaptotetrazole and 4-hydroxy-6-methyl-tetrazaindene as described in Japanese Patent Publication No. 39-2825 and combination use of 4-substituted uracil and cycloalkane-1,3-dione as described in U.S. Pat. No. 3,447,926.

Further, a development accelerator can be included in the silver halide photographic emulsion according to this invention.

As the development accelerator, there are included polyalkylene oxide and its derivatives as described in U.S. Pat. Nos. 2,441,389; 27,081,161; 2,728,162; 2,531,832; 3,158,484; 3,210,191; 2,886,437; 2,533,990 and 3,663,230, Japanese Patent Publications No. 45-10989; No. 45-15188 and No. 47-8106, a quaternary ammonium salt compounds as described in U.S. Pat. Nos. 2,271,623; 2,288,226; 2,334,864; 2,944,900; 3,615,500 and 3,772,021 and British Patent No. 1,145,186, 1,4-thiazine derivative as described in U.S. Pat. No. 3,617,280, pyrrolidine derivative as described in Chemical Abstract 890,863, urethane or urea compound as described in Japanese Patent Publication No. 40-23465, urethane or thiourea compound as described in Japanese Patent Publication No. 45-26471, imidazole or imidazoline derivative as described in U.S. Pat. No. 3,808,003 and Japanese Patent Application No. 50-24689 and onium salt of phosphorus or sulfur as described in U.S. Pat. No. 2,288,226. The above compounds are effective even when they are added in the treatment bath.

The hardening treatment of the emulsion is carried out according to an ordinary manner. Hardening agents used include ordinary hardening agents for photograph, for example, aldehyde compounds such as formaldehyde, glyoxal and glutaraldehyde and derivatives thereof such as a acetal or sodium bisulfite additive. Other hardening agents are:

Methanesulfonic acid ester compounds as described in U.S. Pat. Nos. 2,726,162 and 2,816,125;

Mucochloric acid or mucohalohalogenic acid compounds as described in U.S. Pat. No. 3,110,597 and Japanese Patent L-O-P Publication No. 49-116154 and No. 49-118745;

Epoxy compounds as described in U.S. Pat. Nos. 3,047,394 and 3,091,537;

Aziridine compounds as described in PB Report 19921, U.S. Pat. Nos. 3,017,280 and 2,983,611 and Japanese Patent Publication No. 46-40898;

Active halogen compounds as described in U.S. Pat. Nos. 3,288,775 and 2,732,303 and Japanese Patent L-O-P Publication No. 50-63062;

Maleic acid imide compounds as described in U.S. Pat. Nos. 2,992,109 and 3,232,763;

Active vinyl compounds as described in PB Report 19920, German Patent No. 1,100,942, British Patent No. 1,251,091, Japanese Patent L-O-P Publication No. 49-13563, U.S. Pat. No. 3,490,911, Japanese Patent L-O-P Publication No. 49-116154, Japanese Patent Application No. 49-118457 and No. 50-97090 and U.S. Pat. No. 3,640,720;

Carbodiimide compounds as described in U.S. Pat. No. 2,938,892, Japanese Patent Publication No. 46-38715 and Japanese Patent L-O-P Publication No. 50-109251;

Isooxazole compounds as described in U.S. Pat. No. 3,321,323;

N-methylol compounds as described in U.S. Pat. No. 2,732,316 and Japanese Patent Publication No. 21-569;

Isocyanate compounds as described in U.S. Pat. No. 3,103,437; and

Inorganic hardening agent such as chromium alum and zirconium sulfate.

In the silver halide emulsion of this invention, a surface active agent may be added alone or in admixture with one another.

As the surface active agents, various active agents such as natural products e.g. saponin; nonionic surface active agents, for example, alkylene oxide-, glycerin- and glycidal- series nonionic surface active agents; cationic surface active agents including higher alkylamines, heterocyclic compounds such as pyridine, etc., quaternary nitrogen onium salts, phosphonium or sulfonium compounds; anionic surface active agents including acid group derived from carboxylic acids, sulfonic acids, phosphoric acid, sulfates and phosphates; and amphoteric surface active agents such as amino acids and aminosulfonic acids can be used as the improving agent for the permeability against a coating aid, an emulsifier and a treating solution; a defoaming agent; an antistatic agent; an anti-adhesives; and an agent for improving photographic characteristics or controlling physical properties.

Examples of a part of the above-mentioned surface active agents are described in U.S. Pat. Nos. 2,240,472; 2,271,623; 2,288,226; 2,789,891; 3,026,202; 3,068,101; 3,158,484; 3,294,540; 3,441,413; 3,475,174; 3,514,293; 3,666,478 and 3,850,640, British Patents 548,532; 1,216,389 and 1,293,189, Belgian Patent No. 773,459, Japanese Patent Publications No. 38-12124; No. 40-376; No. 43-13116 and No. 44-26580 and Japanese Patent L-O-P Publication No. 49-46733.

As the antistain agent used for preventing fog or stain brought about often by an undesirable reaction between a coupler and an oxidation product of a developing agent which is caused through air oxidation, etc. a hydroquinone compound is generally used and it can be included conveniently in one of the layers constituting the light-sensitive material of this invention.

For example, alkyl-substituted hydroquinones as described in U.S. Pat. Nos. 2,336,327; 2,360,290; 2,403,721; 2,675,314; 2,701,197; 2,704,713; 2,728,659; 2,732,300 and 3,700,453, British Patent No. 891,158 and Japanese Patent L-O-P Publication No. 50-156438, bishydroquinones as described in U.S. Pat. No. 2,735,765 and further polymer series hydroquinones as described in U.S. Pat. Nos. 2,710,810 and 2,816,028 are typical. These compounds may be added to the light-sensitive material alone or in the combination of two or more compounds.

With a view to reducing a slip friction and to preventing abrasion of film, a lubricant is used on the back surface of the film or on the top of the emulsion layer.

As the useful material for the lubricant, sodium higher alkylsulfate, an ester of higher aliphatic acid and higher alcohol, carbowax, higher alkyl phosphate and silicon compounds are included.

In particular, the compounds as described in U.S. Pat. Nos. 2,882,157; 3,121,060 and 3,850,640 and Japanese Patent Application No. 50-65657 are very effective either when they are used alone or when two or more of them are used together.

The light-sensitive silver halide photographic material of this invention can optionally comprise, in addition to the silver halide emulsion layer, auxiliary layers such as a protective layer, an inter layer, a filter layer, an antihalation layer and a backing layer.

The light-sensitive silver halide photographic material of this invention may include, in the constructive layers (for example, the protective layer, the inter layer, the emulsion layer, the backing layer, etc.), a UV-absorber, for example, benzotriazoles as described in U.S. Pat. Nos. 3,004,896; 3,253,921; 3,533,794; 3,692,525; 3,705,815; 3,738,837 and 3,754,919, British Patent No. 1,321,355 and Japanese Patent L-O-P Publication No. 50-25337, triazines, benzophenone compounds or acrylonitrile compounds as described in U.S. Pat. Nos. 3,052,636 and 3,707,375. Particularly, use of Tinuvin PS, Tinuvin 320, Tinuvin 326, Tinuvin 327 and Tinuvin 328 (products of Ciba-Geigy) alone or in combination is preferable.

The light-sensitive silver halide photographic material of this invention is prepared by the application on a support which has good planeness and shows less variation in size during the manufacture steps or treating steps. Thus, as the support, there may be used plastic film, plastic laminated paper, baryta paper, synthesized paper, or hard material such as glass plate, metal or earthen ware. More particularly, film of cellulose acetate, cellulose nitrate, polyvinyl acetal, polypropylene, polyethylene terephthalate, polyamide, polycarbonate, polystylene or the like, polyethylene laminated paper, polypropylene synthesized paper or baryta paper may be included. These supports may appropriately be selected depending upon the purposes for use of the light-sensitive silver halide photographic material.

To the support, there is in general applied subbing in order to strengthen the adhesion between said support and the photographic emulsion layer. Typical subbing material used for the subbing includes a copolymer of vinyl chlorides or vinylidene chlorides; copolymer of esters of vinyl alcohols; a copolymer containing an unsaturated carboxylic acid; a copolymer of dienes such as butadiene; a copolymer of acetals; a copolymer of unsaturated carboxylic acid anhydrides such as a maleic anhydride, in particular, the copolymer with a vinyl alcohol ester such as vinyl acetate or stylene, or the ring-opened derivatives thereof obtained by means of water, alkali, alcohols or amines as well as cellulose derivatives such as nitrocellulose, diacetylcellulose; epoxy group-containing compounds; gelatin or modified gelatins and polyolefin copolymers. These materials are described in Japanese Patent Publications No. 44-2597; No. 47-12433; No. 47-35458; No. 47-35459; No. 48-7564; No. 48-9965; No. 48-14185 and No. 48-14434, Japanese Patent L-O-P Publications No. 47-14274; No. 47-37921; No. 48-24723; No. 48-89979; No. 48-93672; No. 49-3792; No. 49-11118; No. 49-18977; No. 49-38616; No. 49-99022 and No. 51-3619, U.S. Pat. Nos. 2,331,719; 2,779,684 and 2,943,937, British Patents Nos. 1,134,211 and 1,136,902.

Further, gelatin or polyols, monovalent or polyvalent phenols or halogen-substituted derivatives thereof, cross-linking agents (hardening agent) or metal oxides may be used in the combination with the above-mentioned subbing material to effect subbing process. Such materials are described in Japanese Patent Publications No. 48-24270 and No. 48-43122, Japanese Patent L-O-P Publications No. 47-592; No. 48-23862 and No. 48-26124.

Actually, when a subbing process is applied to the support, the subbing material as mentioned before can be used alone or in combination of two or more of them. By the subbing process, either a single sub layer or superposed sub layers may be formed and as a matter of course, a superposed construction in which an inter layer is arranged to a layer comprising both upper and lower layers of the subbing material can be acceptable. For example, a gelatin layer is superposed on a vinylidene chloride copolymer layer or a layer comprising vinylidene chloride, a layer comprising mixture of gelatin and vinylidene chloride copolymer and a gelatin layer are superposed in this order. These methods of practice may appropriately be selected depending upon purpose.

In addition to the above-mentioned subbing process by means of the subbing materials, further treatments such as corona discharge, glow discharge or other electronic impact, a flame treatment, UV irradiation, oxidation, saponification and roughing on the surface can be made to bring the support into contact with the emulsion layer. These treatments can be effected alone or in combination of two or more of them and further when the above treatments are combined with the subbing process using the above-mentioned subbing material, a satisfactory subbing can be achieved. These treatments are described in Japanese Patent Publication No. 45-3828, Japanese Patent L-O-P Publications No. 47-19824; No. 48-21744; No. 48-85126; No. 48-89731; No. 48-13672; No. 49-1116302 and No. 50-44818, and U.S. Pat. Nos. 3,035,941 and 3,411,908.

On coating the silver halide emulsion layer and other constructive layers of the light-sensitive silver halide photographic material, what method is to be selected is an important factor in order to achieve evenness of quality and productivity. Such method can be selected from, for example, dip coating, double roll coating, air-knife coating, extrusion coating and curtain coating. Among the above methods, the extrusion coating and curtain coating which enable simultaneous coating of two or more layers are particularly useful. Any coating speed can be selected but, from the viewpoint of the productivity, a speed of 30 m/min. or higher is preferable.

Further, with regard to a material which causes due to its rapid reactivity gelation before being coated, when it is previously added to a coating solution, such as, for example, a hardening agent, it is preferable to mix it immediately before coating by means of a static mixer.

The light-sensitive silver halide photographic material of this invention is able to yield an image by being subjected to an ordinary color development after exposure. The basic treatment procedure according to the negative-positive method comprises color development, bleaching and fixing. According to the basic treatment procedure of the reversal method, development with a black and white developing solution and then subjecting to white light-exposure or treatment with a bath containing a fogging agent are effected and thereafter color development, bleaching and fixing are carried out. Each of the above basic treatment procedures may be effected independently or alternatively, two or more treatments may be replaced by one treatment using such treating solution as simultaneously having the functions of said treatments. This type of treatment is exemplified, for example, in Japanese Patent Publication No. 35-1885 in which a monobath color treatment, and a monobath bleach fix treatment are disclosed. Said mono-bath color treatment employs a monobath containing a color developing agent, a ferric salt bleaching component and a thiosulfate fixing component while said monobath bleach-fix treatment employing a monobath containing an (ethylenediaminetetraaceto)iron (III) complex bleaching component and a thiosulfate fixing component.

There is no particular limitation on the method for treatment of the light-sensitive color material of the present invention and any method for treatment can be applied. As the typical methods, for example, the following methods are included: A method in which after color development, bleaching and fixing and, if necessary, further washing with water and stabilization are effected, as described in U.S. Pat. No. 3,582,322; a method in which after color development, bleaching and fixing are effected separately and, if necessary, further washing with water and stabilization are effected, as described in U.S. Pat. No. 910,002; a method in which pre-hardening, neutralization, color development, stop-fixing, washing with water, bleaching, fixing, washing with water, post-hardening and washing with water are carried out in this order, as described in U.S. Pat. No. 3,582,347; a method in which color development, washing with water, complementary color development, stopping, bleaching, fixing washing with water and stabilization are carried out in this order, as described in Japanese Patent L-O-P Publication No. 50-54330; a method in which pre-hardening, neutralization, washing with water, first development, stopping, washing with water, color development, stopping, washing with water, bleaching, fixing and washing with water are carried out in this order, as described in U.S. Pat. No. 3,607,263; a method in which pre-hardening, neutralization, first development, stopping, washing with water, color development, stopping, washing with water, bleaching, organic acid-bath treatment, fixing and washing with water are effected in this order, as described in Japanese Patent L-O-P Publication No. 50-36126; a method in which first development, non-fixative silver dye bleaching, washing with water, color development, acid rinse, washing with water, bleaching, washing with water, fixing, washing with water, stabilization and washing with water are effected in this order, as described in Japanese Patent L-O-P Publication No. 50-81538; a method for development in which after being subjected to the halogenation bleaching, developed silver resulting from color development is color developed again to increase the resulting dye quantity, as described in U.S. Pat. Nos. 2,623,822 and 2,814,565; and a method for treating a light-sensitive material of low silver content by using an amplifier agent such as a peroxide and a cobalt complex, as described in U.S. Pat. Nos. 3,674,990 and 3,761,265; German Patent (OLS) 2,056,360; Japanese Patent L-O-P Publications No. 47-6338 and No. 47-10538; German Patent (OLS) 2,226,770; Japanese Patent L-O-P Publications No. 48-9728 and No. 48-9729. Any method of the above may be used for the treatment of the present light-sensitive material. The above treatments are carried out in some cases at a high temperature above 30° C. in order to achieve a rapid treatment or at a room temperature or, in particular case, at a temperature below 20° C. In general, it is convenient to carry out the treatments at a temperature within the range of 20° C.–70° C. Further, the temperature for each step of the successive treatments may be the same or different.

As the color developing agent, p-phenyldiamine series color developing agents are typical and preferable examples include the following compounds:

4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxyethylamino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-(β-(β-methoxyethoxy)ethoxy)ethyl-3-methyl-4-aminoaniline, N-ethyl-N-β-(β-methoxyethoxy)ethyl-3-methyl-4-aminoaniline and salts thereof, for example, sulfate, hydrochloride, sulfite, p-toluenesulfonate, etc. Further, the compounds as described in Japanese Patent L-O-P Publications No. 48-64932 and No. 50-131526, Japanese Patent Application No. 50-17246 and Hento's Journal of the American Chemical Society, 73, 3100–3125 (1951).

If necessary, various additives can be added to the color developing solution. Principal examples of such additives include alkali agents (for example, hydroxide, carbonate and phosphite of alkali metal or ammonium), pH adjusting agents or buffers (for example, weak acids such as acetic acid or boric acid, weak bases and salts thereof), development accelerators (for example, barious pyridinium compounds and cationic compounds, potassium nitrate and sodium nitrate as described in U.S. Pat. Nos. 2,648,604 and 3,671,247; polyethyleneglycol condensate and its derivatives as described in U.S. Pat. Nos. 2,533,990; 2,577,127 and 2,950,970; nonionic compounds such as polythioethers as described in British Patents Nos. 1,020,032 and 1,020,033; polymer compounds having sulfate esters as described in U.S. Pat. No. 3,068,097; and other pyridines, ethanolamines, organic amines, benzyl alcohol and hydrazines); anti-fogging agents (for example, in addition to alkali bromide, alkali iodide and nitrobenzimidazoles as described in U.S. Pat. Nos. 2,496,940 and 2,656,271, mercaptobenzimidazole, 5-methylbenzotriazole, 1-phenyl-5-mercaptotetrazole; compounds for use in a rapid treatment solution, as described in U.S. Pat. Nos. 3,113,864; 3,342,596; 3,295,976; 3,615,522 and 3,597,199; nitrobenzoic acid as described in Japanese Patent L-O-P Publication No. 49-106832; benzothiazolium derivatives as described in Japanese Patent L-O-P Publication No. 50-137136; phenazine N-oxides as described in Japanese Patent Publication No. 46-41675 and other anti-fogging agent as described in "Scientific Photograph Handbook" second volume, pages 29–47); an anti-stain or anti-sludge agent as described in U.S. Pat. Nos. 3,161,513 and 3,161,514; British Patents 1,030,442; 1,144,481 and 1,251,558; and superposed-layer-effect accelerators and constancy maintaining agents (for example, sulfite, bisulfite, hydroxylamine hydrochloride, formulfite, an alkanolamine sulfite addition product) as described in U.S. Pat. No. 3,536,487.

The light-sensitive materials of this invention are subjected to an ordinary bleaching treatment following to color development. The bleaching treatment may be effected either at the same time as or separately from fixing. The treatment solution used for the bleaching can be made a bleaching and fixing bath by adding, if necessary, a fixing agent.

Various compounds can be used as the bleaching agent, and among them, general examples include potassium ferricyanide, bichromate, iron (III) aminopolycarboxylic acid, an aliphatic polycarboxylic acid metal salt, persulfate, a copper complex as described in British Patents Nos. 774,194; 1,032,024 and 949,440, and Belgian Patent 717,139, a cobalt complex as described in German Patent No. 934,512 and British Patent No. 777,635, iodine as described in Japanese Patent Publication No. 41-11068, bleaching powder and sulfamic acid as described in Japanese Patent Publication No. 41-11068, quinones as described in U.S. Pat. Nos. 2,507,183; 2,529,981 and 2,748,000, and p-sulfophenylquinones or nitron compounds as described in U.S. Pat. Nos. 2,625,477 and 2,705,201, used alone or in an appropriate combination.

Further, to the bleaching or bleaching and fixing solution, there can be added, in addition to the bleaching accelerators as described in U.S. Pat. Nos. 3,042,520 and 3,241,966 and Japanese Patent Publications No. 45-8506 and No. 45-8836, various additives.

Furthermore, the light-sensitive silver halide photographic materials of this invention can be applied to various methods for producing dye images.

The light-sensitive photographic material of this invention is more effective when it is a light-sensitive color material having less silver halide content as described in German Patent (OLS) No. 2,357,964.

In the above-mentioned patent, the content of silver halide is from one-fifth or one-sixth to one-hundredth of the quantity in an ordinary light-sensitive color material, for example, about 65–375 mg/m$^2$ per single layer.

The light-sensitive color photographic material reduced in the silver halide quantity can yield good result by the application, for example, of the developing method as described in U.S. Pat. Nos. 2,623,822 and 2,814,565, in which the developed silver obtained by color development, after being subjected to halogenation bleaching, is color developed again to increase a resulting dye content or of the developing method utilizing color amplification by means of the peroxides as described, for example, in U.S. Pat. Nos. 3,674,490 and 3,751,265, German Patent (OLS) 2,056,360 and Japanese Patent L-O-P Publications No. 47-6338 and No. 47-10538, or the cobalt complexes as described, for example, in German Patents (OLS) 2,226,770 and Japanese Patent L-O-P Publication No. 48-9728.

EXAMPLE 1

Sample 1 was prepared by applying successively from the support side each of the layers as given below on the support comprising a subbed cellulose triacetate film.

Layer — 1: anti-halogen layer

Black colloidal silver was dispersed in an aqueous gelatin solution and coated at the proportion of 3 g of gelatin/m$^2$ and 0.4 g of silver/m$^2$ until 2.0$\mu$ dry film thickness was achieved.

Layer — 2: red-sensitive high speed silver halide emulsion layer

Silver iodobromide emulsion containing 7 mol % of silver iodide (having 1.2$\mu$ of average particle size and containing 0.25 mol of silver halide and 40 g of gelatin per kg of emulsion) was prepared according to an ordinary manner. 1 kg of the emulsion was chemically sensitized by gold and sulfur sensitizers and as red-sensitive sensitizing dyes, anhydrous 9-ethyl-3,3'-di-(3-sulfopropyl)-4,5,4',5'-dibenzothiacarbocyaninehydroxide, and anhydrous 5,5'-dichloro-9-ethyl-3,3'-di-(3-sulfopropyl)thiacarbocyaninehydroxide were added and then 0.25 g of 4-hydroxy-6-methyl-1,3,3a,7-tetrazaindene and 7.5 mg of 1-phenyl-5-mercaptotetrazole, and further 500 ml of dispersion material (C-1: referred to hereinafter and explained later) were added. The red-sensitive high speed silver halide emulsion thus obtained was coated so that 4.5$\mu$ of the dry film thickness was achieved.

Layer — 3: inter layer

Non-light-sensitive silver iodobromide particles having 0.2$\mu$ of average particle size and containing 4 mol % of silver iodide and aqueous gelatine solution in which 1.5 g of polyvinyl pyrrolidone are included per mol of silver halide were coated at the proportion of 1.2 g of gelatin/m$^2$ and 5 mg of silver/m$^2$ so that 1.0$\mu$ of the dry film thickness was achieved (ML-1).

Layer — 4: green-sensitive high speed silver halide emulsion layer

Silver iodobromide emulsion containing 7 mol % of silver iodide (having 1.2$\mu$ of average particle size and containing 0.25 mol of silver halide and 30 g of gelatin per kg of emulsion) was prepared in an ordinary manner. 1 kg of the emulsion was chemically sensitized by gold and sulfur sensitizers and as red-sensitive sensitizing dyes, anhydrous 5,5'-dichloro-9-ethyl-3,3'-di-(3-sulfopropyl)oxacarbocyanine hydroxide; anhydrous 5,5'-diphenyl-9-ethyl-3,3'-di-(3-sulfopropyl)oxacarbocyanine; and anhydrous 9-ethyl-3,3'-di-(3-sulfopropyl)-5,6,5',6'-di-benzoxacarbocyanine hydroxide were added and then 0.25 g of 4-hydroxy-6-methyl-1,3,3a,7-tetrazaindene and 5 mg of 1-phenyl-5-mercaptotetrazole were added. Further, 300 ml of the dispersion material (M-1: referred to therein later and explained later) was added to the above in order to obtain a red-sensitive high speed silver halide emulsion, which was coated so that the dry film thickness was 4.5.

Layer — 5: inter layer

Aqueous gelatin solution was coated at the proportion of 1.0 g of gelatin/m$^2$ so that 1.0$\mu$ of the dry film thickness was achieved.

Layer — 6: yellow filter layer

To aqueous gelatin solution in which yellow colloidal silver has been dispersed, a dispersion solution in which a solution of 3 g of 2,5-di-tert.-octylhydroquinone and 1.5 g of di-2-ethylhexyl phthalate in 10 ml of ethyl acetate has been dispersed in 50 ml of 10% aqueous gelatin solution containing 0.3 g of sodium triisopropyl naphthalenesulfonate was added. The resulting solution was coated at the proportion of 0.9 g of gelatin/m$^2$, 0.07 g of 2,5-di-tert.-octylhydroquinone and 0.12 g/m$^2$ so that 1.2$\mu$ of dry film thickness was achieved.

Layer — 7: blue-sensitive high speed silver halide emulsion layer

Silver iodobromide emulsion containing 7 mol % of silver iodide (having the average particle size of 1.2$\mu$ and containing 0.25 mol of silver halide and 60 g of gelatin per kg of the emulsion) was prepared according to an ordinary process. 1 kg of the above emulsion was sensitized by gold and sulfur sensitizations and then 0.25 g of 4-hydroxy-6-methyl-1,3,3a,7-tetrazaindene and 5 mg of 1-phenyl-5-mercaptotetrazole were added. Then, 350 ml of the dispersion material (Y-1: referred to herein later) and 4 g of 1,2-bisvinylsulfonylethane were added to afford the blue-sensitive high speed silver halide emulsion, which was coated so that 5.0μ of dry film thickness was obtained.

Layer — 8: protective layer

Aqueous gelatin solution containing 4 g of gelatine and 0.2 g of 1,2-bisvinylsulfonylethane per 100 ml was coated at the rate of 1.3 g of gelatin/$m^2$ so that 1.2μ of dry film thickness might be achieved.

The dispersion materials (Y-1), (M-1) and (C-1) used in the layer-2, layer-4 and layer-7 were preapred in the manner as follows:

Dispersion Material (Y-1)

300 g Of exemplified compound (Y-6) as a yellow dye forming coupler were dissolved by heating in 150 g of dibutyl phthalate (DBP) and 500 ml of ethyl acetate. The resulting solution was added to 1600 ml of 7.5% aqueous gelatin solution containing 18 g of sodium triisopropyl naphthalenesulfonate and then emulsified and dispersed by means of a colloid mill to give 2500 ml of dispersion material.

Dispersion Material (M-1)

45 g Of exemplified compound (M-1) and 18 g of exemplified compound (M-3) as a magenta dye forming coupler, and 14 g of exemplified compound (CM-2) and 0.1 g of exemplified compound (D-15) were dissolved by heating in 77 g of tricresyl phosphate and 280 ml of ethyl acetate and the resulting solution was added to 500 ml of 7.5% aqueous gelatine solution containing 8 g of sodium triisopropyl naphthalenesulfonate and then emulsified and dispersed by means of a colloid mill to give 1000 ml of a dispersion material.

Dispersion Material (C-1)

50 g Of exemplified compound (C-4) as a cyan dye forming coupler, 4 g of exemplified compound (CC-4) as a colored cyan coupler and 1.0 g of exemplified compound as a DIR compound were dissolved by heating in the mixture of 55 g of tricresyl phosphate (referred to hereinafter as "TCP") and 110 ml of ethyl acetate and the resulting solution was added to 400 ml of 7.5% aqueous gelatin solution containing 4 g of sodium triisopropyl naphthalenesulfonate and then emulsified and dispersed by means of a colloid mill to give 1000 ml of a dispersion material.

In the manner as mentioned above, Sample 1 was prepared, and further Samples 2 to 24 were also prepared in a similar manner as in Sample 1, except that dispersion material (C-1) used as layer — 2 and the non-light-sensitive inter layer used as layer — 3 of Sample 1 were varied, respectively as specified in Table 1—1 below.

Dispersion materials (C-2) to (C-18) used in Samples 2 to 18 and 22 to 24 were prepared in the following manner:

Dispersion Material (C-2)

The method for the preparation of dispersion material (C-1) was repeated, except that 47 g of exemplified compound (C-3) were used in place of exemplified compound (C-4) as cyan forming coupler and 52 g of TCP and 104 ml of ethyl acetate (referred to hereinafter as "EA") were used.

Dispersion Material (C-3)

The method for the preparation of dispersion material (C-1) was repeated, except that 55 g of exemplified compound (C-21) were used in place of exemplified compound (C-4) as the cyan forming coupler and 60 g of TCP and 120 ml of EA were used.

Dispersion Material (C-4)

The method for the preparation of dispersion material (C-1) was repeated, except that 45 g of exemplified compound (C-28) were used in place of exemplified compound (C-4) as the cyan forming coupler and 50 g of TCP and 100 ml of EA were used.

Dispersion Material (C-5)

The method for the preparation of dispersion material (C-1) was repeated, except that 55 g of exemplified compound (C-41) were used in place of exemplified compound (C-4) as the cyan forming coupler and 60 g of TCP and 120 ml of EA were used.

Dispersion Material (C-6)

The method for the preparation of dispersion material (C-1) was repeated, except that 55 g of exemplified compound (C-39) were used in place of exemplified compound (C-4) as the cyan forming coupler and 60 g of TCP and 120 ml of EA were used.

Dispersion Material (C-7)

The method for the preparation of dispersion material (C-1) was repeated, except that 37 g of exemplified compound (C'-7) were used in place of exemplified compound (C-4) as the cyan forming coupler and 42 g of TCP and 84 ml of EA were used.

Dispersion Material (C-8)

The method for the preparation of dispersion material (C-1) was repeated, except that 42 g of of exemplified compound (C'-4) were used in place of exemplified compound (C-4) as the cyan forming coupler and 47 g of TCP and 94 ml of EA were used.

Dispersion Material (C-9)

The method for the preparation of dispersion material (C-1) was repeated, except that 39 g of exemplified compound (C'-1) were used in place of exemplified compound (C-4) as the cyan forming coupler and 44 g of TCP and 88 ml of EA were used.

Dispersion Material (C-10)

The method for the preparation of dispersion material (C-1) was repeated, except that 1.1 g of exemplified compound (D-24) were used in place of exemplified compound (D-18) as the DIR compound and 55 g of TCP and 120 ml of EA were used.

Dispersion Material (C-11)

The method for the preparation of dipsersion material (C-1) was repeated, except that 0.9 g of exemplified compound (D-15) was used in place of exemplified compund (D-18) as the DIR compound and 55 g of TCP and 120 ml of EA were used.

Dispersion Material (C-12)

The method for the preparation of dispersion material (C-1) was repeated, except that 0.9 g of exemplified compound (D-40) was used in place of exemplified compound (D-18) as the DIR compound and 55 g of TCP and 110 ml of EA were used.

Dispersion Material (C-13)

The method for the preparation of dispersion material (C-1) was repeated, except that 0.7 g of exemplified compound (D-41) was used in place of exemplified compound (D-18) as the DIR compound and 54.7 g of TCP and 110 ml of EA were used.

Dispersion Material (C-14)

The method for the preparation of dispersion material (C-1) was repeated, except that 1.0 g of exemplified compound (D-1) was used in place of exemplified compound (D-18) as the DIR compound 55 g of TCP and 110 ml of EA were used.

Dispersion Material (C-15)

The method for the preparation of dispersion material (C-1) was repeated, except that 0.8 g of exemplified compound (D-8) was used in place of exemplified compound (D-18) as the DIR compound and 54.8 g of TCP and 110 ml of EA were used.

Dispersion Material (C-16)

The method for the preparation of dispersion material (C-1) was repeated, except that 0.7 g of exemplified compound (D-7) was used in place of exemplified compound (D-18) as the DIR compound and 54.7 g of TCP and 110 ml of EA were used.

Dispersion Material (C-17)

The method for the preparation of dispersion material (C-1) was repeated without addition of DIR compound (D-18) as used therein.

Dispersion Material (C-18)

The method for the preparation of dispersion material (C-9) was repeated without the addition of DIR compound (D-18) as used therein.

In each of the samples, the amount of dispersion material ((C-2) to (C18)) added to the emulsion for use in coating layer — 2 is 500 ml per kg of the emulsion.

Further, in Samples 19, 20 and 21, layer 13 3 (ML-2, ML-3 and ML-4, respectively) as the non-light-sensitive hydrophilic colloid layer was coated on the layer — 2 in the following manner:

(ML-2)

An aqueous gelatin solution containing non-light-sensitive silver chloride particles having 0.2μ of average particle size was coated at the rate of 1.2 g of gelatin/m² and 5 mg of silver/m² (dry film thickness: 1.0μ).

(ML-3)

An aqueous gelatin solution containing non-light-sensitive silver bromide particles having 0.2μ of average particle size coated at the rate of 1.2 g of gelatin/m² and 5 mg of silver/m² (dry film thickness: 1.0μ).

(ML-4)

An aqueous gelatin solution free from non-light-sensitive silver halide particle was coated at the rate of 1.2 g of gelatin/m² (dry film thickness: 1.0μ).

Table 1—1

| | Layer-2 | | | | |
|---|---|---|---|---|---|
| | | Content of Dispersion Material | | | Layer-3 |
| Sample | Dispersion Material | Cyan Coupler | DIR Compound | Inter Layer | Silver Halide in Inter Layer |
| 1 | C - 1 | C - 4 | D - 18 | ML - 1 | Silver iodobromide |
| 2 | C - 2 | C - 3 | D - 18 | ML - 1 | " |
| 3 | C - 3 | C - 21 | D - 18 | ML - 1 | " |
| 4 | C - 4 | C - 28 | D - 18 | ML - 1 | " |
| 5 | C - 5 | C - 41 | D - 18 | ML - 1 | " |
| 6 | C - 6 | C - 39 | D - 18 | ML - 1 | " |
| 7 | C - 7 | C - 7 | D - 18 | ML - 1 | " |
| 8 | C - 8 | C' - 4 | D - 18 | ML - 1 | " |
| 9 | C - 9 | C' - 1 | D - 18 | ML - 1 | " |
| 10 | C - 10 | C - 4 | D - 24 | ML - 1 | " |
| 11 | C - 11 | C - 4 | D - 15 | ML - 1 | " |
| 12 | C - 12 | C - 4 | D - 40 | ML - 1 | " |
| 13 | C - 13 | C - 4 | D - 41 | ML - 1 | " |
| 14 | C - 14 | C - 4 | D - 1 | ML - 1 | " |
| 15 | C - 15 | C - 4 | D - 8 | ML - 1 | " |
| 16 | C - 16 | C - 4 | D - 7 | ML - 1 | " |
| 17 | C - 17 | C - 4 | — | ML - 1 | " |
| 18 | C - 18 | C' - 1 | — | ML - 1 | " |
| 19 | C - 1 | C - 4 | D - 18 | ML - 2 | Silver chloride |
| 20 | C - 1 | C - 4 | D - 18 | ML - 3 | Silver bromide |
| 21 | C - 1 | C - 4 | D - 18 | ML - 4 | — |
| 22 | C - 18 | C' - 1 | — | ML - 4 | — |
| 23 | C - 9 | C' - 1 | D - 18 | ML - 4 | — |
| 24 | C - 17 | C - 4 | — | ML - 4 | — |

The above-mentioned samples were, after being exposed through (optical wedge) to white light, subjected to the color development according to the treatment steps as defined below:

| Treatments (38° C.) | Treatment Time |
|---|---|
| Color development | 3 min. 15 sec. |
| bleaching | 6 min. 30 sec. |
| washing with water | 3 min. 15 sec. |
| fixing | 6 min. 30 sec. |
| washing with water | 3 min. 15 sec. |
| stabilization | 1 min. 30 sec. |

The composition of the treating solution used in each of the above treatments is as follows:

| | |
|---|---|
| 4-amino-3-methyl-N-ethyl-N-(β-hydroxyethyl)aniline sulfate | 4.8 g |
| anhydrous sodium sulfite | 0.14 g |
| hydroxyamine . ½ sulfate | 1.98 g |
| sulfuric acid | 0.75 mg |
| anhydrous potassium carbonate | 28.85 g |
| anhydrous potassium hydrogen carbonate | 3.46 g |
| anhydrous potassium sulfite | 5.10 g |
| potassium bromide | 1.16 g |
| sodium chloride | 0.14 g |
| nitrilotriacetic acid . 3 sodium salt (monohydrate) | 1.20 g |
| potassium hydroxide | 1.48 g |
| water to make up 1 liter. | |
| Composition of the bleaching solution: | |
| ethylenediaminetetraacetic acid iron ammonium salt | 100.0 g |
| ethylenediaminetetraacetic acid 2 ammonium salt | 10.0 g |
| ammonium bromide | 150.0 g |
| glacial acetic acid | 10.0 ml |
| water to make up 1 liter, | |
| pH being adjusted to 6.0 with aqueous ammonia. | |
| Composition of the fixing solution: | |
| ammonium thiosulfate | 175.0 g |
| anhydrous sodium thiosulfite | 8.6 g |
| sodium metasulfite | 2.3 g |
| water to make up 1 liter, | |
| pH being adjusted to 6.0 with acetic acid. | |

-continued

| | |
|---|---|
| Composition of the stabilizing solution: | |
| formalin (37% aqueous solution) | 1.5 ml |
| Konidax (product of Konishiroku Photo Industry Co., Ltd.) | 7.5 ml |
| water to make up 1 liter. | |

Subsequently, fog, speed and granularity were measured based on the color images formed in the samples and comparative samples. The results obtained are shown in Table 1–2 together with the results of the following Examples:

In Tables, fog, speed and granularity for each color image-forming unit layer are of measured values obtained when exposure to white light was applied. For is expressed by a value obtained by subtracting a mask density from a minimum density, speed being expressed by a relative value assuming the speed value of the cyan image-forming unit layer of Sample 9 (to which exposure to white light has been subjected) as 100 while granularity (RMS) is represented by 1000 times value of the standard deviation of the variation of speed value as brought about in scanning with microdensitometer having 2.5μ of circular scanning sperture.

Table 1–2

| | Fog | γ-value | Relative Speed | Granularity (RMS) |
|---|---|---|---|---|
| 1 | 0.11 | 0.56 | 175 | 31 |
| 2 | 0.12 | 0.54 | 170 | 30 |
| 3 | 0.11 | 0.55 | 170 | 30 |
| 4 | 0.11 | 0.55 | 150 | 30 |
| 5 | 0.11 | 0.52 | 130 | 31 |
| 6 | 0.11 | 0.51 | 135 | 30 |
| 7 | 0.11 | 0.49 | 110 | 29 |
| 8 | 0.11 | 0.53 | 105 | 28 |
| 9 | 0.11 | 0.56 | 100 | 28 |
| 10 | 0.11 | 0.56 | 175 | 31 |
| 11 | 0.11 | 0.56 | 180 | 33 |
| 12 | 0.11 | 0.58 | 145 | 28 |
| 13 | 0.12 | 0.57 | 140 | 29 |
| 14 | 0.11 | 0.57 | 120 | 27 |
| 15 | 0.11 | 0.54 | 150 | 35 |
| 16 | 0.11 | 0.56 | 160 | 34 |
| 17 | 0.20 | 0.65 | 165 | 48 |
| 18 | 0.11 | 0.59 | 120 | 38 |
| 19 | 0.15 | 0.52 | 150 | 36 |
| 20 | 0.13 | 0.54 | 140 | 32 |
| 21 | 0.11 | 0.42 | 140 | 27 |
| 22 | 0.11 | 0.56 | 100 | 34 |
| 23 | 0.10 | 0.40 | 90 | 26 |
| 24 | 0.13 | 0.56 | 160 | 44 |

From the resalts shown in Table 1–2, it is apparent that the desired high sensitivity and high image qualities cannot be achieved when even any one of the essential requirements of this invention is omitted and thus only the light-sensitive color photographic material of this invention, which satisfys the above essential requirements is totally excellent in the sensitivity and image qualities.

EXAMPLE 2

On a support comprising triacetate film, each of the layers as mentioned below was applied successively starting from the support side to obtain a light-sensitive multi-layer color photographic material. Sample 25.

Layer — 1: antihalation layer

This layer — 1 is the same as Layer — 1 of Sample 1 described in Example 1 (dry film thickness: 2.0).

Layer — 2: inter layer

This layer — 2 is the same as Layer — 5 of Sample 1 described in Example 1.

Layer — 3: red-sensitive, low speed silver halide emulsion layer

According to an ordinally method, silver iodobromide emulsion containing 4 mol% of silver iodide was prepared, said emulsion having 0.6μ of average particle size and containing 0.25 mol of silver halide and 40 g of gelatin per kg of the emulsion. The, 1 kg of the emulsion was sensitized by gold and sulfur sensitizers and further as a red-sensitive sensitizing dye, anhydrous 9-ethyl-3,3'-di-(3-sulfopropyl)-4,5,4',5'-dibenzothia-carbocyanine hydroxide and anhydrous 5,5'-dichloro-9-ethyl-3,3'-di-(3-sulfopropyl)-thiacarbocyanine hydroxide were added. Then, 0.25 g of 4-hydroxy-6-methyl-1,3,3*a*,7-tetrazaindene and 7.5 mg of 1-phenyl-5-mercaptotetrazole were added and thereafter 500 ml of dispersion material (C-18) and 60 ml of dispersion material (I-1) were added. The red-sensitive low speed silver halide emulsion this prepared was coated so that 3.8μ of dry film thickness was achieved.

Layer — 4: red-sensitive high speed silver halide emulsion layer

To the emulsion for use in coating layer — 2 of Sample 17 described in Example 1, dispersion material (D-1) was added to give the red-sensitive high speed silver halide emulsion layer, dispersion material (C-17) and dispersion material (D-1) being in the equivalent volume, respectively (dry film thickness: 1.3μ).

Layer — 5: inter layer

This layer — 5 is the same as Layer — 3 of Sample 1 described in Example 1.

Layer — 6: green-sensitive low speed silver halide emulsion layer

According to an ordinary method, silver iodobromide emulsion containing 4 mol% of silver iodide was prepared, said emulsion having 0.6μ of average particle size and containing 0.25 mol of silver halide and 40 g of gelatin per kg of emulsion. 1 kg of the resulting emulsion was sensitized by gold and sulfur sensitizing agents and further as green-sensitive sensitizing dyes, anhydrous 5,5'-dichloro-9-ethyl-3,3'-di-(3-sulfopropyl)oxacarbocyanine hydroxice, anhydrous 5,5'-diphenyl-9-ethyl-3,3'-di-(3-sulfopropyl)oxacarbocyanine and anhydrous 9-ethyl-3,3'-di-(3-sulfopropyl)-5,6,5',6'-dibenzooxacarbocyanine hydroxide were added, and then 0.25 g of 4-hydroxy-6-methyl-1,3,3a,7-tetrazaindene and 5 mg of 1-phenyl-5-mercaptotetrazole were added and thereafter 300 ml of dispersion material (M-1) were added. The green-sensitive low speed silver halide emulsion thus prepared was coated so that 4.0μ of dry film thickness was achieved.

Layer — 7: green-sensitive high speed silver halide emulsion layer

This layer — 7 is the same as the emulsion used for layer — 2 of Sample 1 described in Example 1 (dry film thickness: 1.5μ).

Layer — 8: inter layer

This layer is the same as layer — 5 of Sample 1 described in Example 1.

Layer — 9: yellow filer layer

This layer is the same as layer — 6 of Sample 1 described in Example 1.

Layer — 10: blue-sensitive low speed silver halide emulsion layer

According to an ordinary method, silver iodobromide containing 6 mol% of silver iodide was prepared, said emulsion having 0.6μ of average particle size and containing 1 mol of silver halide and 360 g of gelatin per 3 kg of emulsion. 1 kg of the resulting emulsion was subjected to chemical sensitization and then 0.25 g of 4-hydroxy-6-methyl-1,3,3a,7-tetrazaindene and 5 mg of 1-phenyl-5-mercaptotetrazole were added and further 350 ml of the dispersion material were added. The blue-sensitive low speed silver halide emulsion thus prepared was coated so that 4.2μ of dry film thickness was achieved.

Layer — 11: blue-sensitive high speed silver halide emulsion layer

This layer — 11 is the same as layer — 7 of Sample 1 described in Example 1.

Layer — 12: inter layer 24 g of di-2-ethylhexylphthalate (referred to hereinafter as "DOP") and 12 ml of ethyl acetate were mixed and dispersed in 50 ml of 10% gelatin solution containing 0.6 g of sodium triisopropylnaphthalenesulfonate to give a dispersion material. Aqueous gelatine solution to which the dispersion material was added was coated at the rate of 1.0 g of gelatin/m$^2$ (dry film thickness: 1.0μ).

Layer — 13: protective layer

This layer — 13 is the same as layer — 8 of Sample 1 described in Example 1.

The afore-mentioned dispersion material (D — 1) was prepared as follows:

Dispersion Material (D-1)

15 g of DIR compound (D-1) were dissolved by heating in 45 ml of ethyl acetate. The resulting solution was added to 100 ml of 10% gelatin solution and the mixture was emulsified and dispersed by means of a colloid mill to give 360 ml of the dispersion material.

In a similar manner as the Sample 25, the following Samples 26 to 28 were prepared:

Sample 26

This sample is a light-sensitive multi-layer color photographic material having the same construction as Sample 25, except that dispersion material (D - 1) as used in the emulsion for use in coating layer — 3 and layer — 4 of Sample 25 described in Example 2 is not added.

SAMPLE 27

This sample is a light-sensitive multi-layer color photographic material having the same construction as Sample 25, except that the non-light-sensitive silver iodobromide particles as used in layer — 5 of Sample 25 described in Example 2 is not used.

Sample No. 28

This sample is a light-sensitive multi-layer color photographic material having the same construction as Sample 26, except that the non-light-sensitive silver iodobromide particles as used in layer — 5 of Sample 26 described in Example 2 is not used.

Samples thus prepared were treated in the similar manner as in Example 1. With regard to the sensitivities of the red-sensitive layer and green-sensitive layer, fog, γ-value and granularlity, the results of measurements obtained on the same day and after 3 days maintained under the condition of 55° C. of temperature and 10% of relative humidity are shown in Table — 2.

From the results as shown in Table — 2, it is apparent that the light-sensitive color material according to this invention is totally excellent in every point in comparison with the other comparative materials. In particular, it is evident that improvement in the preservability is for excellent over that as achieved by prior art.

Table - 2

| | Properties on the same day | | | | | Properties after preservation | | | |
|---|---|---|---|---|---|---|---|---|---|
| | red-sensitive layer | | | | green-sensitive layer | red-sensitive layer | | | green-sensitive layer |
| Sample | fog | γ-value | speed | granularity (RMS) | γ-value | fog γ-value | speed | γ-value | |
| 25 | 0.15 | 0.57 | 190 | 30 | 0.66 | 0.16 | 0.57 | 180 | 0.66 |
| 26 | 0.17 | 0.61 | 210 | 39 | 0.66 | 0.22 | 0.60 | 170 | 0.66 |
| 27 | 0.14 | 0.50 | 90 | 28 | 0.63 | 0.16 | 0.49 | 80 | 0.59 |
| 28 | 0.15 | 0.57 | 100 | 33 | 0.66 | 0.17 | 0.56 | 90 | 0.65 |

EXAMPLE 3

On a support comprising a triacetate film, each of the following layers was applied successively starting from the support side to obtain Sample 25:

Layer — 1: antihalation layer

This layer — 1 is the same as layer — 1 of Sample 1 described in Example 1.

Layer — 2: inter layer

This layer — 2 is the same as layer — 5 of Sample 1 described in Example 1.

Layer — 3: red-sensitive low speed silver halide emulsion layer

This layer — 3 is the same as layer — 3 of Sample 1 described in Example 2, except that dispersion material (19) was used in place of the dispersion material as used in layer — 3 (dry film thickness: 3.3μ).

Layer — 4: red-sensitive middle speed silver halide emulsion layer (dry film thickness: 0.8μ).

According to an ordinary method, silver iodobromide emulsion containing 3.3 mol% of silver iodide was prepared, said emulsion having 0.8μ of average particle size and containing 0.25 mol of silver halide and 40 g of gelatin per kg of the emulsion. 1 kg of the emulsion was sensitized by using as the chemical sensitizer gold and sulfur sensitizing agents, and further as red-sensitive sensitizing dyes anhydrous 9-ethyl-3,3'-di-(3-sulfopropyl)-4,5,4',5'-dibenzothiacarbocyanine hydroxide, anhydrous 5,5-dichloro-9-ethyl-3,3'-di-(3-sulfopropyl)-thiacarbocyanine hydroxide were added, and then 0.25 g of 4-hydroxy-6-methyl-1,3,3*a*,7-tetrazaindene and 7.5 mg of 1-phenyl-5-mercaptotetrazole were added and finally 500 ml of dispersion material (C-1) was added. The red-sensitive middle speed silver halide emulsion thus prepared was coated so that 0.8μ of dry film thickness was achieved.

Layer — 5: red-sensitive high speed silver halide emulsion layer

This layer — 5 comprises the same as used in layer — 2 of Sample 17 described in Example 1 (dry film thickness: 1.3μ).

Layer — 6: inter layer

This layer — 6 is the same as layer — 3 of Sample 1 described in Example 1 (dry film thickness: 1.0μ).

Layer — 7: green-sensitive low speed silver halide emulsion layer

This layer — 7 is the same as layer — 6 of Sample 1 described in Example 1 (dry film thickness: 3.6μ).

Layer — 8: green-sensitive middle speed silver halide emulsion layer (dry film thickness: 0.8μ)

According to an ordinary method, silver iodobromide emulsion containing 3.3 mol% of silver iodide was prepared, said emulsion having 0.8μ of average particle size and containing 0.25 mol of silver halide and 30 g of gelatin per kg of the emulsion. To 1 kg of the emulsion were added gold and sulfur sensitizing agents as chemical sensitizers, further as green-sensitive sensitizing dyes, anhydrous 5,5'-dichloro-9-ethyl-3,3'-di-(3-sulfopropyl)oxacarbocyanine hydroxide, anhydrous 5,5'-diphenyl-9-ethyl-3,3'-di-(3-sulfopropyl)oxacarbocyanine, and anhydrous 9-ethyl-3,3'-di-(3-sulfopropyl)-5,6,5',6'-dibenzooxacarbocyanine hydroxide, and then 0.25 g of 4-hydroxy-6-methyl-1,3,3a,7-tetrazaindene and 5 mg of 1-phenyl-5-mercaptotetrazole, and finally 300 ml of dispersion material (M-1). The green-sensitive middle speed silver halide emulsion thus obtained was coated so that 0.8μ of dry film thickness was achieved.

Layer — 9: green-sensitive high speed silver halide emulsion layer

This layer — 9 is the same as layer — 2 of Sample 1 described in Example 1 (dry film thickness: 1.5μ).

Layer — 10: yellow filter layer

This layer — 10 is the same as layer — 5 of Sample 1 described in Example 1 (dry film thickness: 1.2μ).

Layer — 11: blue-sensitive low speed silver halide emulsion layer

This layer — 11 is the same as layer — 10 of Sample 1 described in Example 2 (dry film thickness: 3.8μ).

Layer — 12: blue-sensitive middle speed silver halide emulsion layer (dry film thickness: 0.8μ)

According to an ordinary method, a silver iodobromide emulsion containing 3.3 mol% of silver iodide was prepared, said emulsion having 0.8μ of average particle size and containing 0.25 mol of silver halide and 40 g of gelatin per kg of emulsion. 1 kg of the resulting emulsion was subjected to the chemical sensitization using gold and sulfur sensitizing agents and then 0.25 g of 4-hydroxy-6-methyl-1,3,3a,7-tetrazaindene and 5 mg of 1-phenyl-5-mercaptotetrazole and further 330 ml of dispersion material (Y-1) were added to the emulsion. The blue-sensitive middle speed silver halide emulsion layer thus prepared was coated so that 0.8μ of dry film thickness was achieved.

Layer — 13: blue-sensitive high speed silver halide emulsion layer

This layer — 13 is the same as layer — 7 of Sample 1 described in Example 1 (dry film thickness: 1.5μ).

Layer — 14: protective layer

This layer — 14 is the same as layer — 8 of Sample 1 described in Example 1 (dry film thickness: 1.2μ).

Sample No. 30

A light-sensitive multi-layer color photographic material having the same construction as Sample 29, except that in place of dispersion material (C-19) and dispersion material (C-1) as used in the layer — 3 and layer — 4 of Sample 29, dispersion material (C-20) and dispersion material (C-17) were used, respectively.

Sample 31

A light-sensitive multi-layer color photographic material having the same construction as Sample 29, except that the non-light-sensitive silver iodobromide particles as used in layer — 6 of Sample 29 were not used.

Sample 32

A light-sensitive multi-layer color photographic material having the same construction as Sample 29, except that in place of dispersion material (C-19), dispersion material (C-1) and dispersion material (C-17) as used in layer — 3, layer — 4 and layer — 5 of Sample 29, dispersion material (C-22), dispersion material (C-7) and dispersion material (C-21) were used, respectively.

The above-mentioned dispersion materials (C-19), (C-20) and (C-21) were prepared as follows:

Dispersion Material (C-19)

The method for the preparation of dispersion material (1) was repeated, except that there was used 25 g of exemplified compound (C-1) and 25 g of exemplified compound (C-9) as the cyan dye forming coupler, 4 g of exemplified compound (CC-1) as the colored coupler and 1.0 g of exemplified compound (D-1) as the DIR compound, 55 g of tri-o-cresyl phosphate and 110 ml of ethyl acetate.

Dispersion Material (C-20)

The method for the preparation of dispersion material (1) was repeated, except that DIR compound (D-1) used in the above dispersion material (C-19) was omitted.

Dispersion Material (C-21)

The method for the preparation of dispersion (1) was repeated, except that 50 g of exemplified compound (C-7) as the cyan dye forming coupler, 50 g of tri-o-cresyl phosphate and 110 ml of ethyl acetate were used.

Dispersion Material (C-22)

The method for the preparation of dispersion material (1) was repeated, except that 25 g of exemplified compound (C-7) and 25 g of exemplified compound (C-9) as the cyan dye forming coupler, 4 g of exemplified compound (CC-1) as the colored coupler, 1.0 g of exemplified compound (D-1) as the DIR compound, 55 g of tri-o-cresyl phosphate and 110 ml of ethyl acetate were used.

Each of the samples of the light-sensitive materials thus obtained was exposed and treated in a similar manner as in Example 1, and thereafter speed, fog, γ-value and granularity were measured thereof. Results of the measurement are shown in Table — 3.

The speed referred to in the Table means the relative speed to the speed of Sample 32, which was assumed as 100.

From the results of Table — 3, it is apparent that according to the samples of this invention, much more excellent results can be achieved in comparison with those obtained by other samples.

Table - 3

| Sample | Properties on the same day Red-sensitive layer | | | |
|---|---|---|---|---|
| No. | fog | γ-value | speed | granularity (RMS) |
| 29 | 0.15 | 0.57 | 180 | 31 |
| 30 | 0.17 | 0.63 | 185 | 37 |
| 31 | 0.15 | 0.52 | 160 | 29 |
| 32 | 0.15 | 0.57 | 100 | 28 |

EXAMPLE 4

On a support comprising a triacetate film, each of the following layers were applied successively starting from the support side to obtain Sample 33:

Layer — 1: antihalation layer

This layer — 1 is the same as layer — 1 of Sample 1 described in Example 1.

Layer — 2: inter layer

This layer — 2 is the same as layer — 5 of Sample 1 described in Example 1.

Layer — 3: red-sensitive low speed silver halide emulsion layer

This layer — 3 is the same as layer — 3 of Sample 25 described in Example 2.

Layer — 4: inter layer

This layer — 4 is the same as layer — 5 of Sample 1 described in Example.

Layer — 5: green-sensitive low speed silver halide emulsion layer

This layer — 5 is the same as layer — 6 of Sample 25 described in Example 2.

Layer — 6: inter layer

This layer — 6 is the same as layer — 5 of Sample 1 described in Example 1.

Layer — 7: red-sensitive high speed silver halide emulsion layer

This layer — 7 is the same as layer — 4 of Sample 25 described in Example 2.

Layer — 8: inter layer

This layer — 8 is the same as layer — 3 of Sample 1 described in Example 1.

Layer — 9: green-sensitive high speed silver halide emulsion layer

This layer — 9 is the same as layer — 7 described in Example 2.

Layer — 10: yellow filter layer

This layer — 10 is the same as layer — 6 of Sample 1 described in Example 1.

Layer — 11: blue-sensitive silver halide emulsion layer

This layer — 11 is the same as layer — 7 of Sample 1 described in Example 1.

Layer — 12: protective layer

This layer — 12 is the same as layer — 8 of Sample 1 described in Example 1.

Sample 34

A light-sensitive multi-layer color photographic material having the same construction as Sample 33, except that dispersion material (C-17) was used in place of dispersion material (C-1) as used in layer — 7 of Sample 33.

Sample 35

A light-sensitive multi-layer color photographic material having the same construction as the Sample 33, except that there is not used the nonlight-sensitive silver halide particles as used in layer — 8 of Sample 33.

The same exposure and treatments as in Example 1 were carried out using Samples 33 35 thus obtained and the results are shown in Table — 4 as given below were obtained.

Table 4

| Sample No. | Properties on the same day Red-sensitive layer | | | |
|---|---|---|---|---|
| | fog | γ-valve | relative speed | granularity (RMS) |
| 33 | 0.15 | 0.57 | 180 | 32 |
| 34 | 0.17 | 0.62 | 185 | 39 |
| 35 | 0.15 | 0.50 | 100 | 30 |

From the results as shown in the above Table — 4, it is apparent that the light-sensitive color material of this invention has particularly high speed and is excellent in the image quality.

EXAMPLE 5

On a support comprising a triacetate film, each of the following layers was applied successively starting from the support side to give Sample 37:

Layer — 1: antihalation layer

This layer — 1 is the same as layer — 1 of Sample 1.

Layer — 2: inter layer

This layer — 2 is the same as layer — 5 of Sample 1.

Layer — 3: red-sensitive high speed silver halide emulsion layer

According to an ordinary method, silver iodobromide emulsion containing 7 mol% of silver iodide was prepared, said emulsion having 1.3μ of average particle size and containing 0.25 mol of silver halide and 40 g of gelatin per kg of the emulsion. After the chemical sensitization of 1 kg of the resulting emulsion with gold and sulfur sensitizing agents, there were added to the emulsion, as red-sensitive sensitizing dyes, anhydrous 9-ethyl-3,3'-di-(3-sulfopropyl)-4,5,4',5'-dibenzothia-carbocyanine hydroxide and anhydrous 9-ethyl-3,3'-di-(3-sulfopropyl)-5,6,5',6'-dibenzooxacarbocyanine hydroxide, then 0.25 g of 4-hydroxy-6-methyl-1,3,3*a*,7-tetrazaindene and 5 mg of 1-phenyl-5-mercaptotetrazole and further 0.6 g of propyl gallate. In addition, 500 ml of dispersion material (C-23) was added to the emulsion to give the red-sensitive high speed silver halide emulsion, which was coated so that 4.5μ of dry film thickness was achieved.

Layer — 4: inter layer

This layer — 4 is the same as layer — 5 of Sample 1.

Layer — 5: inter layer

This layer — 5 is the same as layer — 3 of Sample 1.

Layer — 6: inter layer

This layer — 6 is the same as layer — 5 of Sample 1.

Layer — 7: green-sensitive high speed silver halide emulsion layer

This layer — 7 is the same as layer — 4 of Sample 1.

Layer — 8: yellow filter layer

This layer — 8 is the same as layer — 6 of Sample 1.

Layer — 9: blue-sensitive high speed silver halide emulsion layer

According to an ordinary method, silver iodobromide emulsion containing 7 mol% of silver iodide was prepared, said emulsion having 1.3μ of average particle size and containing 0.25 mol of silver halide and 60 g of gelatin per kg of the emulsion. After the chemical sensitization of 1 kg of the above emulsion with gold and sulfur selenium sensitizing agents, there were added to the emulsion, as a blue-sensitive sensitizing dye, anhydrous 3,3'-di-(3-sulfopropyl)-selenacyanine hydroxide, then 1.0 g of 4-hydroxy-6-methyl-1,3,3*a*,7-tetrazaindene and 0.02 g of 1-phenyl-5-mercaptotetrazole and further 0.6 g of propyl gallate. To the emulsion thus obtained was further added 330 ml of dispersion material (Y-1) to give the blue-sensitive high speed silver halide emulsion, which was coated so that 5.0μ of dry film thickness was achieved.

Layer — 10: protective layer

This layer — 10 is the same as layer — 8 of Example 1.

Sample 38

A light-sensitive multi-layer color photographic material having the same construction as the Sample 37 except that there were not used the non-light-sensitive silver halide particles as used in layer — 5 of Sample 37.

Dispersion material (C-23) as used in layer — 3 was prepared as follows:

The method for the preparation of dispersion material (C-1) was repeated, except that there were used 50 g of exemplified compound (C-4) as the cyan coupler, 4 g of exemplified compound (CC-4) as the colored cyan coupler, 1 g of dodecyl gallate, 55 g of tricresyl phosphate and 110 ml of ethyl acetate.

The same exposure and treatments as in Example 1 were carried out using Samples 37 and 38 thus prepared and the results were as shown in Table — 5.

Table 5

| Sample No. | fog | Properties on the same day Red-sensitive layer γ-value | relative speed | granularity (RMS) |
|---|---|---|---|---|
| 37 | 0.09 | 0.56 | 175 | 31 |
| 38 | 0.09 | 0.42 | 135 | 29 |

From the results as shown in the above Table — 5, it is apparent that the light-sensitive color photographic material of this invention has very high speed and excellent image quality.

What is claimed is:

1. A light-sensitive silver halide color photographic material which comprises a support and (A) a red-sensitive silver halide emulsion layer, (B) a non-light-sensitive layer adjacent to the red-sensitive silver halide emulsion layer, and (C) a light-sensitive silver halide emulsion layer adjacent to the non-light-sensitive layer, coated on the support in this order, the non-light-sensitive layer comprising substantially non-light-sensitive silver halide grains, the red-sensitive silver-halide emulsion layer comprising (D) a DIR compound which releases a development inhibiting compound on the reaction with an oxidation product of an aromatic primary amine developing agent and (E) a 2-equivalent cyan coupler which is substantially colorless and represented by the general formula (I) or (II):

$$C_p - Y \quad \text{(I)}$$

$$C_p - X - C_p \quad \text{(II)}$$

wherein $C_p$ represents a phenol cyan coupler residue, an α-naphthol cyan coupler residue or a pyrazoloquinozolone cyan coupler residue; Y represents $-OR_1$ or

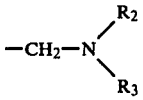

(wherein $R_1$, $R_2$ and $R_3$ individually represent an alkyl group, an alkenyl group, an aryl group, an acyl group, a carbamoyl group, a sulfamoyl group, a sulfonyl group, morpholino, piperazyl, imidazolyl, furyl, imidazolinyl, tetrazolyl, pyrimidinyl, pyrrolyl, pyrrolidinyl, thiazinyl, thiazolinyl, thiazolyl, and thienyl or $R_2$ and $R_3$ can cooperatively form a member selected from imidazolidinyl, imidazolinyl, imidazolyl, morpholino, oxazolidinyl, piperidino, pyrazinyl, pyrazolidinyl, pyrazolinyl, pyrazolyl, pyrrolyl, pyrrolidinyl, pyrrolinyl, tetrazolyl, thiazolidinyl, triazolidinyl and triazolyl or $-NHCOR_4$ or $-NHSO_2R_4$ (wherein $R_4$ represents an aliphatic hydrocarbon residue, an alicyclic hydrocarbon residue, an aromatic hydrocarbon residue, morpholino, piperazyl, imidazolyl, furyl, imidazolidinyl, tetrazolyl, pyrimidinyl, pyrrolyl, pyrrolidinyl, thiazinyl, thiazolinyl, thiazolyl and thienyl and X represents $-O-X_1-O-$, $$-CH-\underset{\underset{R_2}{|}}{N}-X_1-,\quad -\underset{\underset{R_2}{|}}{N}-CH_2-,$$

—NHCO—$X_1$—CONH— or —$NHSO_2$—$X_1$—$SO_2$—NH— (wherein $X_1$ represents $$(J_3)_w X_2 \{ J_1 (X_3 (J_2 - X_3)_z J_1)_y X_2 \}_x (J_3)_w$$

wherein $J_1$ and $J_2$ individually represent —S—, —O—, —CO—, $$-\overset{O}{\overset{\|}{C}}-O-,$$

$$-O-\overset{O}{\overset{\|}{C}}-,$$

—SO—, —$SO_2$—, —NHCO—, —CONH—, —NH$SO_2$— or —$SO_2$NH—, $J_3$ represents —$SO_2$—, —CONH— or —CO—; $X_2$ and $X_3$ individually represent an alkylene group, an arylene group, an aralkylene group, an arylenealkylene group, or a 2,4-pyrimidine residue, x, y and z individually represent 0 or 1 and w represents 0 or 1, provided that when $X_1$ is attached to oxygen, w represents 1.

2. A light-sensitive silver halide color photographic material according to claim 1 wherein $R_1$ is represented by $$(L_1)_t (R_5-L_2(R_6-O)_u)_v R_7 \text{ wherein } L_1$$

wherein $L_1$ represents—$SO_2$—, —CO—, —CONH—, —CONHCO— or —CONH$SO_2$—, $L_2$ represents —CO—, —COO—, —O—, —$SO_2$—, —NHCO—, —$NR_7'$CO— ($R_7'$ represents a lower alkyl group), —OCO— or —CONH—, $R_5$ and $R_6$ individually represent an alkylene group, a phenylene group or a naphthylene group, $R_7$ represents an alkyl group having 1–4 carbon atoms, a phenyl group, a naphthyl group, a phenylalkyl group having 7–10 carborn atoms, an alkylphenyl group having 7–10 carbon atoms, a naphthylalkyl group having 11–14 carbon atoms, an alkylnaphthyl group having 11–14 carbon atoms, tetrazolyl, and pyridyl, t and v each represent 0 or 1 and u represents 0, 1, 2, or 3.

3. A light-sensitive silver halide color photographic material according to claim 1 wherein $R_4$ represents an alkyl group, an alkenyl group, a cyclo-alkyl group, a monovalent group derived from terpen by removal of one hydrogen, an aryl group, morpholino, piperazyl, imidazolyl, furyl, imidazolidinyl, tetrazolyl, pyrimidinyl, pyrrolyl, pyrrolidinyl, thiazinyl, thiazolinyl, thiazolyl, and thienyl.

4. A light-sensitive silver halide color photographic material according to claim 1 wherein $C_p$ is represented by the general formula (III), (IV) or (V);

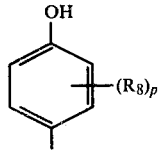

(III)

-continued

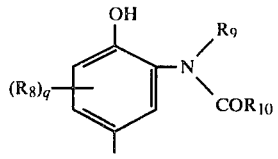

(IV)

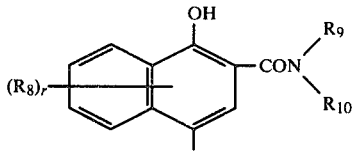

(V)

wherein $R_8$ represents hydrogen, halogen, or aliphatic hydrocarbon residue, an acylamino group —O—$R_{11}$ or —S—$R_{11}$ (wherein $R_{11}$ represents an aliphatic hydrocarbon residue), $R_9$ represents an aliphatic hydrocarbon residue, an aryl group, morpholino, piperazyl, pyridinyl, furyl, quinolyl, pyrrolyl, pyrrolidinyl, thienyl, piperidyl, tetrazolyl, thiazinyl, thiazolinyl, imidazolyl, oxazolyl, imidazolidinyl, benzoxazolyl, benzimidazolyl, and benzothiazolyl, $R_{10}$ represents hydrogen or $R_9$, p represents an integer of 1–4, q represents an integer of 1–3 and r represents an integer of 1–5.

5. A light-sensitive silver halide color photographic material according to claim 4 wherein the aliphatic hydrocarbon residue is an alkyl group, an alkenyl group or a monovalent group derived from a terpen by removal of one hydrogen.

6. A light-sensitive silver halide color photographic material according to claim 1 wherein the DIR compound is represented by the following general formula (VI), (VII), (VIII), (IX), (X), (XI), or (XII):

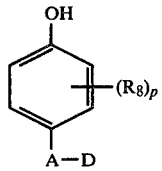

(VI)

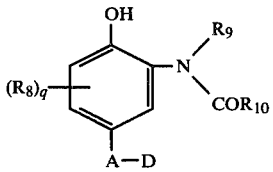

(VII)

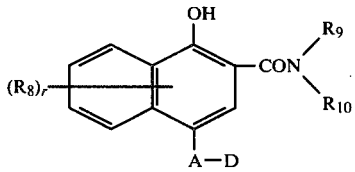

(VIII)

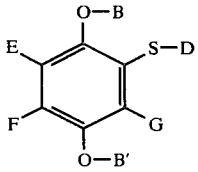

(IX)

-continued

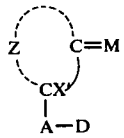

(X)

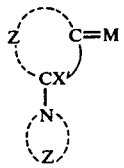

(XI)

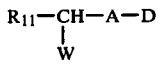

(XII)

wherein A represents sulfur or selenium, D represents a group which forms, together with A or the sulfur, a compound possessing the development inhibiting action when A or the sulfur is split-off from the originally attached carbon atoms, E, F and G individually represent hydrogen, hydroxy, halogen, an alkyl group, an alkoxy group, an amino group, tetrazolyl, oxazolyl, imidazolyl, thiazolyl, quinolinyl or -S-D, Z represents a non-metal atomic group necessary for forming a hydrocarbon ring or a 5- to 7-membered heterocyclic ring containing at least one selected from nitrogen, oxygen, and sulfur, Z' represents a non-metal atomic group which forms, together with the nitrogen when the C-N linkage is cleavaged, a heterocyclic group selected from a benztriazole group, a naphthotriazole group, an indazole group, a pyrazole group, a thiohydantoin group, and a rhodanine group, $R_8$ represents hydrogen, halogen, an aliphatic hydrocarbon residue, an acylamino group —O—$R_{11}$ or —S—$R_{11}$ (wherein $R_{11}$ represents an aliphatic hydrocarbon residue), $R_9$ represents an aliphatic hydrocarbon residue, an aryl group, morpholino, piperazyl, pyridinyl, furyl, quinolyl, pyrrolyl, pyrrolidinyl, thienyl, piperidyl, tetrazolyl, thiazinyl, thiazolynyl, imidazolyl, oxazolyl, imidazolidinyl, benzoxazolyl, benzimidazolyl, and benzothiazolyl, M represents oxygen or N-L (L represents hydroxy or an amino group), X' represents hydrogen or halogen, $R_{11}$ represents —COR', —$CONH_2$, —CONHR',

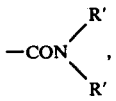

—$SO_2$—R', —$SO_2$—OR',

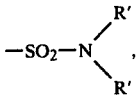

—COOR',

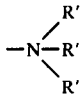

or —CN (R' represents an alkyl group, an alkenyl group, an aryl group, or a 5- or 6-membered heterocyclic ring containing at least one member selected from oxygen, nitrogen, and sulfur wherein said ring may be fused with a benzene or naphthalene ring), and W represents hydrogen, halogen, an alkyl group, an alkoxy group, an aryloxy group, an aryl group, a 5- or 6-membered heterocyclic ring, which contains at least one member selected from oxygen, nitrogen, and sulfur wherein said ring may be fused with a benzene or naphthalene ring, a heterocyclic group wherein the heteroalkyl group is a 5- or 6-membered heterocyclic ring containing at least one member selected from oxygen, nitrogen, and sulfur and wherein said ring may be fused with a benzene or naphthaline ring, an acyloxy group or —A—D, further, when two or more R's are contained in the group

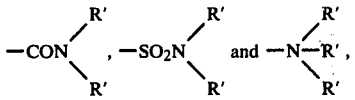

two R's can form, together with the nitrogen, a heterocyclic ring containing the nitrogen.

7. A light-sensitive silver halide color photographic material according to claim 6 wherein —A—D represents a mercaptotertazole group, a mercaptothiazole group, a mercaptooxadiazole group, a mercaptothiadiazole group, a mercaptotriazine group, a mercaptotriazole group, an arylmercapto group, 1-phenyl-5-selenotetrazole, 2selenobenzoxazole, 2-selenobenzthiazole, and a selenobenzene group.

8. A light-sensitive silver halide color photographic material according to claim 1 wherein $R_2$ and $R_3$ individually represent an alkyl group or an arylalkyl group.

9. A light-sensitive silver halide color photographic material according to claim 6 wherein B and B' individually represent hydrogen, an acyl group, an alkoxycarbonyl group or an alkoxyoxalyl group.

10. A light-sensitive silver halide color photographic material according to claim 6 wherein the DIR compound is represented by general formula (IX), (X), (XI) or (XII).

11. A light-sensitive silver halide color photographic material according to claim 6 wherein the DIR compound is represented by general formula (X), (XI) or (XII).

12. A light-sensitive silver halide color photographic material according to claim 6 wherein the DIR compound is represented by general formula (X) or (XII).

13. A light-sensitive silver halide color photographic material according to claim 6 wherein the DIR compound is represented by general formula (X).

14. A light-sensitive silver halide color photographic material according to claim 1 wherein an average size of the substantially non-light-sensitive silver halide grains is not more than 1μ.

15. A light-sensitive silver halide color photographic material according to claim 14 wherein the average size is not more than 0.3μ.

* * * * *